US006994246B2

(12) United States Patent
Ichikawa et al.

(10) Patent No.: US 6,994,246 B2
(45) Date of Patent: Feb. 7, 2006

(54) PACKAGING CASE

(75) Inventors: Haruo Ichikawa, Kanagawa (JP); Akira Wakabayashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 153 days.

(21) Appl. No.: 10/390,930

(22) Filed: Mar. 19, 2003

(65) Prior Publication Data

US 2003/0178335 A1 Sep. 25, 2003

(30) Foreign Application Priority Data

Mar. 20, 2002 (JP) ..... 2002-078891
Mar. 20, 2002 (JP) ..... 2002-078892
Mar. 20, 2002 (JP) ..... 2002-078893

(51) Int. Cl.
*B66D 5/46* (2006.01)

(52) U.S. Cl. ..... 229/117.22; 229/930; 229/931; 206/391; 206/806

(58) Field of Classification Search ..... 229/117.22, 229/920, 930, 931
See application file for complete search history.

(56) References Cited

U.S. PATENT DOCUMENTS 2,848,154 A * 8/1958 Hanson ..... 229/117.14
2,979,192 A * 4/1961 Blonder ..... 206/321
4,146,128 A * 3/1979 Hogg et al. ..... 206/776
4,291,807 A * 9/1981 Giordano et al. ..... 229/212
4,344,533 A * 8/1982 Olsen ..... 206/459.5
4,949,845 A * 8/1990 Dixon ..... 229/212
5,474,183 A * 12/1995 Warren et al. ..... 206/459.5
5,842,632 A * 12/1998 Van Hest ..... 229/153
6,471,122 B1 * 10/2002 Stewart et al. ..... 229/125.09
6,755,300 B2 * 6/2004 Brizzi ..... 206/273

FOREIGN PATENT DOCUMENTS

| | | |
|---|---|---|
| JP | 6-17743 | 5/1994 |
| JP | 6-43600 | 11/1994 |
| JP | 6-43800 | 11/1994 |
| JP | 11-115914 | 4/1999 |
| JP | 2000-313433 | 11/2000 |

* cited by examiner

*Primary Examiner*—Anthony D. Stashick
*Assistant Examiner*—Jerrold Johnson
(74) *Attorney, Agent, or Firm*—Sughrue Mion, PLLC

(57) ABSTRACT

A packaging case which can store a plurality of stored items, enables the stored items to be individually removed, and prevents the occurrence of formation failures. First broken cut lines (perforations) extend from a first flat plate (a side plate) over one flat plate (side plate) neighboring the first flat plate (side plate), and form openings through which the stored items (cartridge containers) can be taken out individually. A second broken cut line (perforation) is formed at a joining portion between the first flat plate (side plate) and the one flat plate (side plate) neighboring the first flat plate (side plate).

5 Claims, 20 Drawing Sheets

22
14
72
80
10
20
74
1
16
12
24
26

PACKAGING CASE

BACKGROUND OF THE INVENTION

1. Field of the Invention

The present invention relates to a packaging case which collects and packages a plurality of stored items such as, for example, containers which accommodate cartridges incorporating photographic films, or the like.

The present invention further relates to a packaging case having a header which enables pendent display from a suspending hanger at a time of sales display at a store front of stored items such as, for example, containers which accommodate cartridges incorporating photographic films or the like, the header being formed by a protruding piece in which a suspension opening is formed, into which opening the suspending hanger is inserted.

2. Description of the Related Art

Prior Art 1

Heretofore, there have been numerous packaging cases that package collected pluralities of stored items. Many of these packaging cases are convenient in that the plurality of stored items stored in the packaging case can be taken out one at a time rather than having to be taken out all together. Photographic films are a representative example of such stored items.

Conventionally, a format for packaging photographic films or the like has been to accommodate cartridges which store photographic films in roll form in containers made of synthetic resin (below referred to as "cartridge containers"), individually accommodate the cartridge containers in boxes for packaging, and sell the same. However, in recent years, as usage volumes of photographic film have increased, formats in which cartridge containers are plurally collected and sold have become more abundant.

A plurality of cartridge containers are taken out from such a packaging case at one time, but it is very unusual for all of the plurality of photographic films that are taken out from the packaging case to be required during an ordinary photographic shoot. Cartridge containers that store photographic films that are not immediately required are difficult to completely distinguish from cartridge containers that store used photographic films by visual appearance. Thus, confusion of these two types of cartridge containers may occur.

Accordingly, of cartridge containers that store photographic films, cartridge containers that are taken out from a packaging case individually are convenient with regard to avoiding situations in which used photographic films and unused photographic films are mixed up.

With a view to solving this problem, Japanese Utility Model Application Publication (JP-Y) No. 6-43800 discloses a packaging case (a carton for packaging) having perforations which form openings that enable stored items to be taken out individually. This packaging case (carton for packaging) enables the stored items to be taken out as required, and is extremely convenient. However, when faces in which the perforations are formed and faces adjacent to those faces are formed by folding at a time of assembly of this packaging case, reaction forces are concentrated at the perforations, and formation failures in which steps are formed at the perforations and/or the perforations are broken occur often.

Prior Art 2

Heretofore, in order to use display space efficiently for selling packaging cases accommodating stored items such as, for example, containers which accommodate cartridges incorporating photographic films or the like, pendent display of the packaging cases storing the stored items has been carried out at a display stand. In order for stored items to be displayed for sale at a store front in this manner, the packaging cases are provided with protruding pieces (headers) in which are formed suspension openings through which a suspending hanger is inserted.

When products are produced in a factory and these products are to be packed in packaging cases and shipped to intermediaries such as retailers, distributors and the like, the packaging cases may be collected and aggregated in a packaging format known as shrink film packaging. Shrink film packaging is a packaging format in which goods are packed imprecisely in a plastic film known as shrink film, which is heat-shrinkable to a thin film form by pressure-forming or the like, the shrink film is shrunk by hot air, and the goods are tightly contacted with one another in this wrapped state.

Generally, because the headers which are provided with suspension openings protrude from the packaging cases, the shrink film packaging is carried out such that the protruding pieces (headers) are folded so as to abut against faces of the packaging cases.

However, even when the headers are packed so as to closely contact the packaging cases by shrink film wrapping, the headers may interfere with the packaging case faces and end up sticking up. This is a problem in that appearance is poor. In these circumstances, packaging cases whose headers fold up easily are being called for.

Prior Art 3

A packaging case for accommodating containers that store cartridges or the like is produced by assembling a development sheet, from an unfolded state formed by die-cutting, into a cuboid shape with a folding assembly machine known as a sack machine or the like. Generally, first, a quadrilateral tube is formed from the development sheet. Besides the aforementioned protruding piece (header), portions referred to as flaps are respectively provided continuously at both of opening ends of the quadrilateral tube. These flaps are folded in, and thus the cuboid packaging case is produced.

However, when the quadrilateral tube is to be formed from the development sheet in the unfolded state, or when the flaps are to be folded orthogonally, problems often occur in which side edges of the protruding piece (header) abut against and catch onto side edges of flaps that are adjacent to the protruding piece: formation of the quadrilateral tube becomes impossible, and/or the flaps cannot be folded. In particular, such problems are remarkably evident in cases in which a width of the protruding piece (header) is large, and improvements are being called for.

SUMMARY OF THE INVENTION

An object of the present invention is to solve various problems of the prior art. Specifically, one object of the present invention is to provide a packaging case which can store a plurality of stored items, enables the stored items to be taken out individually, and avoids the occurrence of formation failures.

Another object of the present invention is to provide a packaging case at which a header provided with a suspension opening can be easily folded to abut against a face of the packaging case.

Yet another object of the present invention is to provide a packaging case with a broad header which has excellent assembly accuracy and avoids the occurrence of formation failures.

In order to achieve the above-described objects, in accordance with a first aspect of the present invention, a packaging case including a main body a substantially quadrilateral tube, the packaging case being capable of storing a plurality of items substantially in a row along a longitudinal direction of the main body, the packaging case comprising: (I)a first panel for structuring the main body; (II)a second panel for structuring the main body, which opposes the first panel; (III)a third panel for structuring the main body, which connects the first panel and the second panel; (IV)a fourth panel for structuring the main body, which opposes the third panel and connects the first panel and the second panel; (V)a fifth panel for covering a first opening at one end of the main body in the longitudinal direction; (VI)a sixth panel for covering a second opening at the other end of the main body in the longitudinal direction; (VII)a first non-continuous incision line formed across the third panel from the first panel for enabling formation of a plurality of apertures for individual removal of the items; and (VIII)a second non-continuous incision line formed at a joining portion of the first and third panels.

In accordance with a further aspect of the present invention, a packaging case including a main body having the form of a substantially quadrilateral tube, the packaging case being capable of storing a plurality of items substantially in a row along a longitudinal direction of the main body, the packaging case comprising: (I)a first panel for structuring the main body; (II)a second panel for structuring the main body, which opposes the first panel; (III)a third panel for structuring the main body, which connects the first panel and the second panel; (IV)a fourth panel for structuring the main body, which opposes the third panel and connects the first panel and the second panel; (V)a fifth panel for covering a first opening at one end of the main body in the longitudinal direction; (VI)a sixth panel for covering a second opening at the other end of the main body in the longitudinal direction; (VII)a first protruding piece connected with the first panel via a first non-continuous incision line; and (VIII)a second protruding piece connected with the first protruding piece via a fold line and including a second non-continuous incision line at a position spaced a predetermined distance from a distal end thereof, the second protruding piece being folded in a direction of entering into the main body and superposed with the first protruding piece, and the second protruding piece, together with the first protruding piece, structuring a header, (IX) wherein positions of the first non-continuous incision line and the second non-continuous incision line are vertically higher than a position of the fifth panel when the fifth panel has closed off the first opening.

In accordance with a still further aspect of the present invention, a packaging case including a main body having the form of a substantially quadrilateral tube, the packaging case comprising: (I)a first panel for structuring the main body; (II)a second panel for structuring the main body, which opposes the first panel; (III)a third panel for structuring the main body, which connects the first panel and the second panel; (IV)a fourth panel for structuring the main body, which opposes the third panel and connects the first panel and the second panel; (V)a fifth panel for covering a first opening at one end of the main body; (VI)a sixth panel for covering a second opening at the other end of the main body; (VII)a first protruding piece connected with the first panel; (VIII)a second protruding piece connected with the first protruding piece via a fold line, the second protruding piece being folded in a direction of entering into the main body and superposed with the first protruding piece, and the second protruding piece, together with the first protruding piece, structuring a header; and (IX)a flap connected with one of the third panel and the fourth panel via a fold line, (X) wherein a maximum dimension of the header in a direction parallel to the fifth panel is greater than a dimension of the first panel in a direction parallel to the fifth panel, and the flap is formed with an outline maintaining a predetermined separation (t) from the header in a foldout state of the packaging case, such that the flap does not physically interfere with the header.

DESCRIPTION OF THE PREFERRED EMBODIMENTS

<<First Embodiment>>

Figure 1:
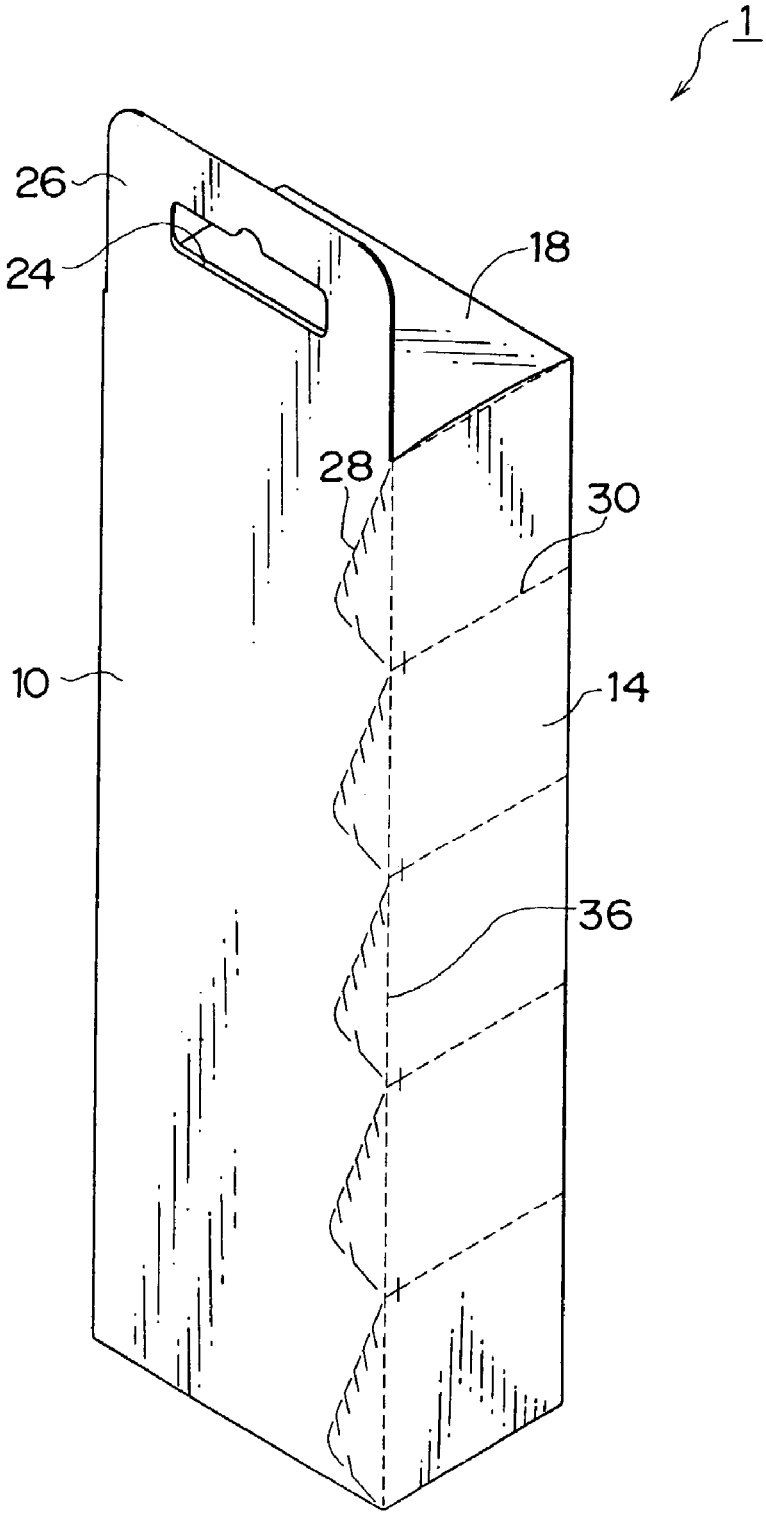
FIG. 1 is a perspective view showing a packaging case relating to a first embodiment of the present invention.
Figure 2:
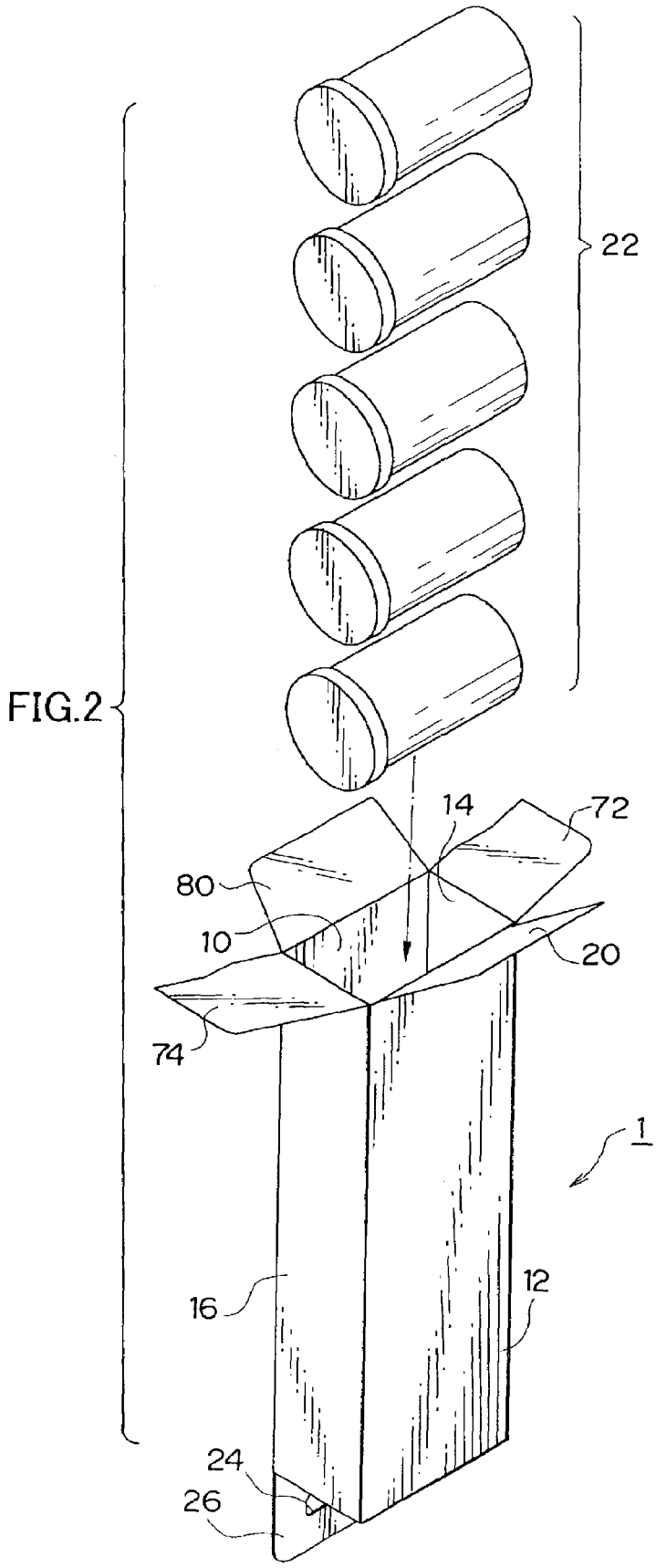
FIG. 2 is an exploded perspective view showing the packaging case relating to the first embodiment of the present invention.

Now, a first embodiment of the present invention will be described with reference to FIGS. 1 to 6. Note that elements that have substantially the same functions are given the same reference numerals throughout all the drawings, and descriptions thereof will be omitted as appropriate. This also applies to other embodiments which are described later.

It should also be noted that certain terms used herein, such as "front", "back", "side", "top", and "bottom", are used to facilitate the description of the preferred embodiments of the invention and are not intended as a limitation on the position the package may be in at any stage of its fabrication or handling, either before or after being filled with (a) product(s).

A packaging case 1 shown in FIGS. 1 to 4 is structured in a cuboid shape which includes side plates 10, 12, 14 and 16, a top plate 18, a bottom plate 20 and a header 26. The side plates 10 to 16 (a first flat plate (panel) to a fourth flat plate (panel)) form a quadrilateral tube. The top plate 18 (a fifth flat plate (panel)) covers an opening at one end of the quadrilateral tube (a first opening). The bottom plate 20 (a sixth flat plate (panel)) covers an opening at the other end of the quadrilateral tube (a second opening). The header 26 is provided with a hanging opening 24. The packaging case 1 has a form which stores five horizontally oriented cylinder-like cartridge containers 22 (stored items) arrayed in the quadrilateral tube structured by the side plates 10 to 16. The cartridge containers 22 accommodate cartridges (not shown) in which photographic films (not shown) are stored in roll form. Note that the number of stored items is not limited to five, and can be appropriately selected from any number of two or greater.

Five triangular waveform perforations 28 (first non-continuous incision lines) are formed at an edge of the side plate 10 of the packaging case 1 that is at one end of a length in a transverse direction of the side plate 10, respectively corresponding to storage positions of the cartridge containers 22. Perforations 30 (the first non-continuous incision lines) are formed in the side plate 14, which is adjacent to the side plate 10, continuously with respect to end points of the triangular waveform perforations 28 of the side plate 10, and partition the side plate 14 in a longitudinal direction thereof. Thus, by breaking the triangular waveform perforations 28 of the side plate 10 and breaking the perforations 30 of the side plate 14 that are formed continuously with the corresponding triangular waveform perforations 28, openings through which the cartridge containers 22 can be taken out individually are formed.

Figure 3:
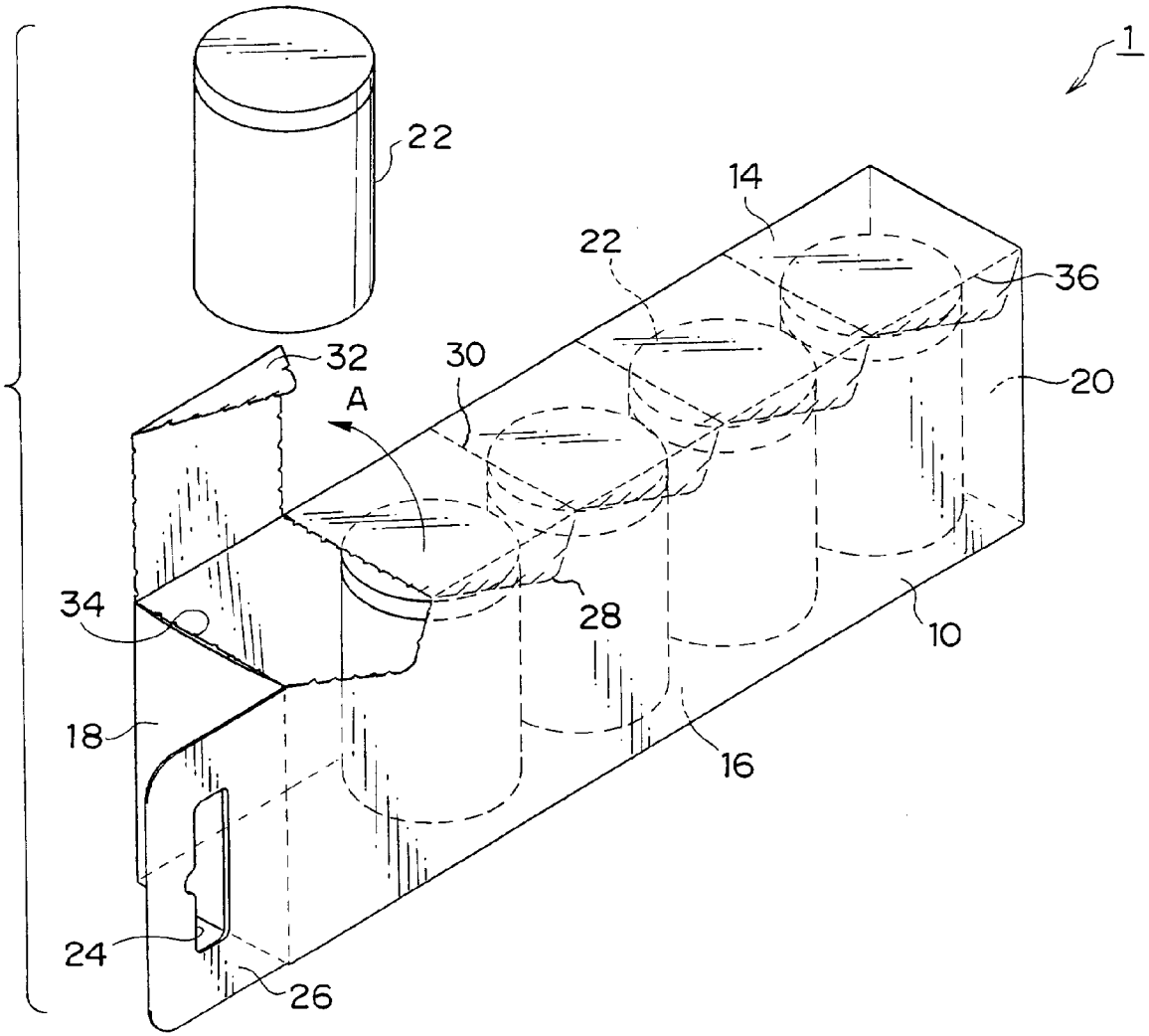
FIG. 3 is a schematic view explaining a state in which the packaging case relating to the first embodiment of the present invention is opened.
Figure 4:
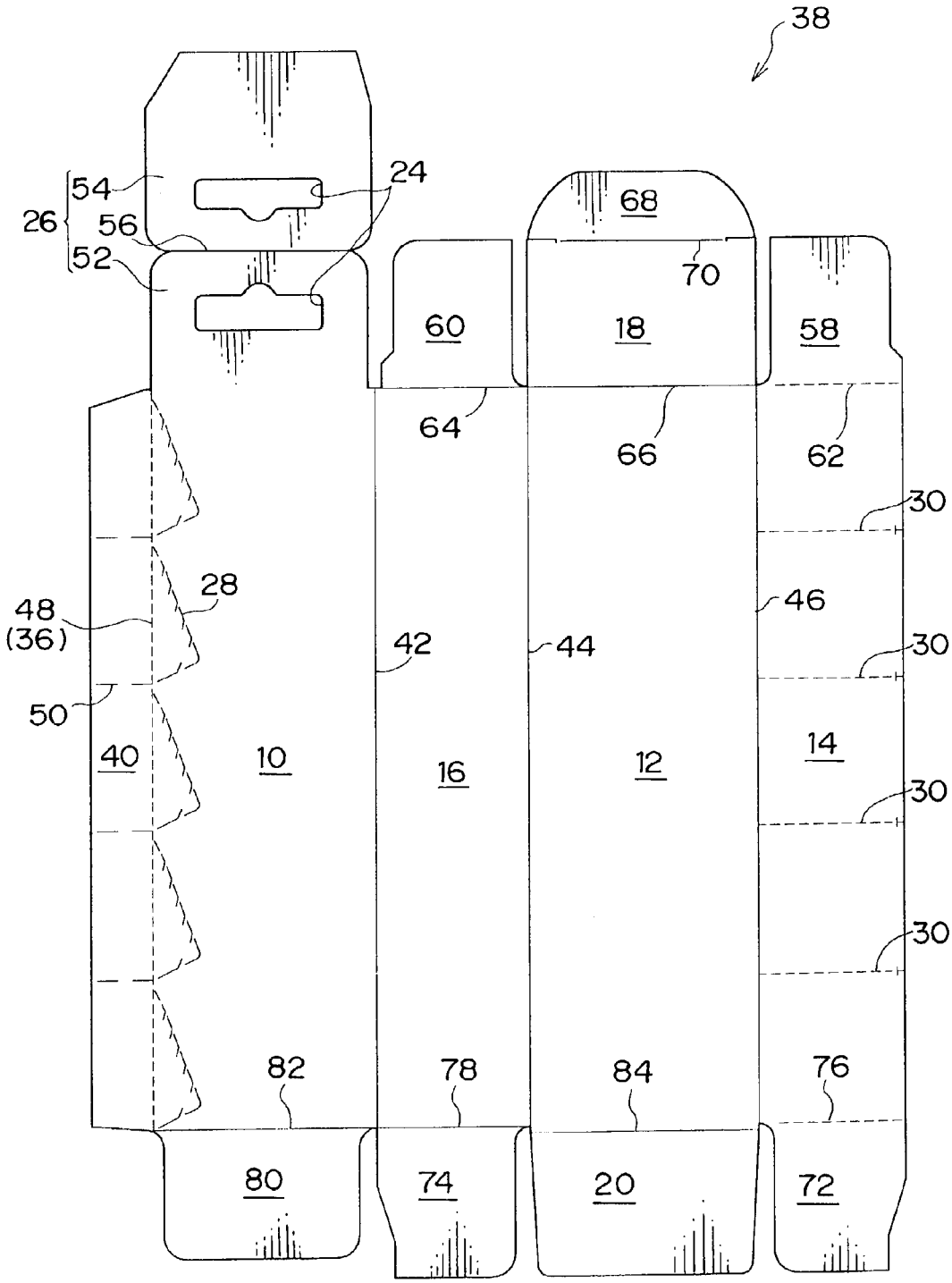
FIG. 4 is a development view, seen from an inner side, showing an unfolded state of the packaging case relating to the first embodiment of the present invention.

Specifically, as shown in FIG. 3, first, a finger is set against one of the triangular waveform perforations 28 and that portion of the triangular waveform perforations 28 breaks and is pushed inside of the packaging case 1. Next, a tongue piece 32, which is formed by the breakage of the triangular waveform perforation 28, is pinched and pulled up in the direction of an arrow A such that the perforations 30 of the side plate 14 are broken, and an opening 34 is formed. As a result, the cartridge containers 22 can be individually taken out through these openings 34. Photographic films in the cartridge containers 22 that are stored at unopened portions of the packaging case 1 are unused films. Thus, used and unused films can be clearly distinguished, and occurrences of problems due to mistaken identification, as in the prior art, can be avoided.

In this packaging case 1, a perforation 36 (a second non-continuous incision line) is formed at a portion joining the side plate 10, in which the triangular waveform perforations 28 are formed, with the side plate 14, which includes the perforations 30 which are formed to connect with the triangular waveform perforations 28. In this embodiment, the perforation 36 (the second non-continuous incision line) is formed on a fold line 48 between the side plate 10 and a later-described gluing overlap plate 40, which affixes the side plate 10 with the side plate 14.

A paper product sheet (a blank) 38 of the packaging case 1 in an unfolded state is formed with the side plates 10 to 16 and the gluing overlap plate 40 being joined via respective fold lines 42, 44, 46 and 48. The perforation 36 is formed at the fold line 48 between the side plate 10 and the gluing overlap plate 40 as described above. Furthermore, when the gluing overlap plate 40 is to be affixed to the side plate 14, perforations 50 (third non-continuous incision lines) are formed at positions to superpose the perforations 30 of the side plate 14. A paper grain of the paper product sheet 38 runs in a direction substantially intersecting the fold lines 42 to 48.

A first protruding piece 52 and a second protruding piece 54, which structure the header 26, are formed to be connected in series at the side plate 10. The first protruding piece 52 and second protruding piece 54 are formed to be joined via a fold line 56.

Inner flaps 58 and 60 are formed at the side plate 14 and 16 and joined therewith via fold lines 62 and 64, respectively. The inner flaps 58 and 60 each extend as far as a central vicinity of the one end opening of the quadrilateral tube formed by the side plates 10 to 16 and cover the one end opening (the first opening). The fold line 62 is formed with a perforation which, together with the perforations 30 of the side plate 14, forms the openings through which the respective stored items can be taken out individually. The top plate 18, which covers the one end opening of the quadrilateral tube formed by the side plates 10 to 16, is formed at the side plate 12 via a fold line 66. A tongue piece 68 is formed at the top plate 18, via a fold line 70. The tongue piece 68 is abutted against the side plate 10 when the top plate 18 covers the one end opening of the quadrilateral tube formed by the side plates 10 to 16.

Inner flaps 72 and 74 are formed at the side plates 14 and 16 and joined therewith via fold lines 76 and 78, respectively. The inner flaps 72 and 74 each extend as far as a central vicinity of the other end opening of the quadrilateral tube formed by the side plates 10 to 16 and cover the other end opening (the second opening). An outer flap 80 is formed at the side plate 10 via a fold line 82. The outer flap 80 covers the other end opening of the quadrilateral tube formed by the side plates 10 to 16. The bottom plate 20, which covers the other end opening of the quadrilateral tube formed by the side plates 10 to 16, is formed at the side plate 12 via a fold line 84.

The packaging case 1 is formed by folding the paper product sheet 38 in the unfolded state up, with valley folds along the respective fold lines, and affixing predetermined portions. Herein, folding of the fold lines is not particularly limited. As well as valley folds and mountain folds, folding portions include folding lines and the like that are represented by perforations, scoring and folding portions, which are specified at a printing line, an automatic box-making machine or the like.

First, the second protruding piece 54 is folded up along the fold line 56, the second protruding piece 54 is affixed to the first protruding piece 52, and a distal end of the second protruding piece 54 is affixed to an inner wall of the side plate 10. Thus, the header 26 is formed.

Figure 5:
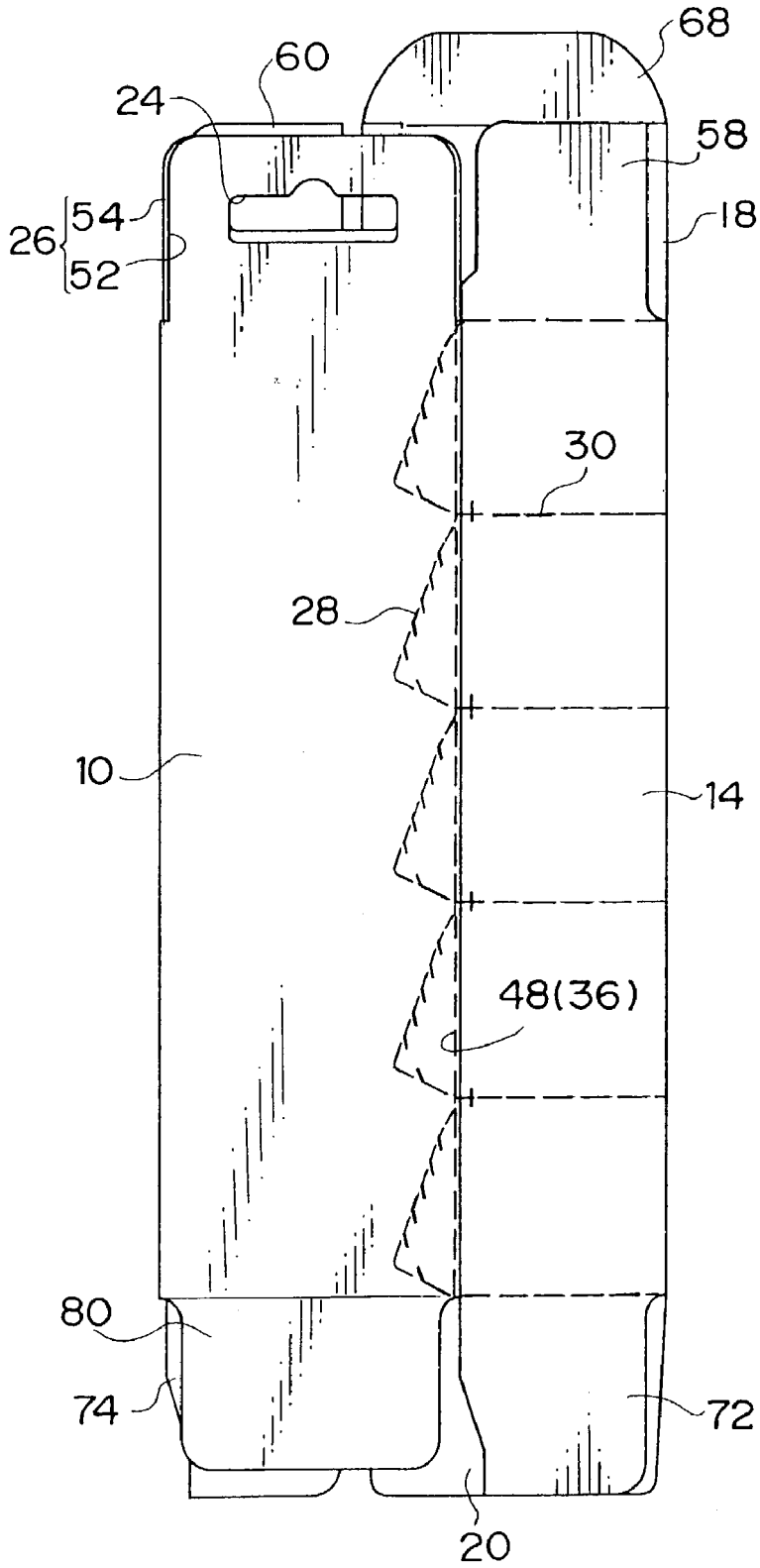
FIG. 5 is a schematic view explaining a process for assembling the packaging case relating to the first embodiment of the present invention from the unfolded state.
Figure 6:
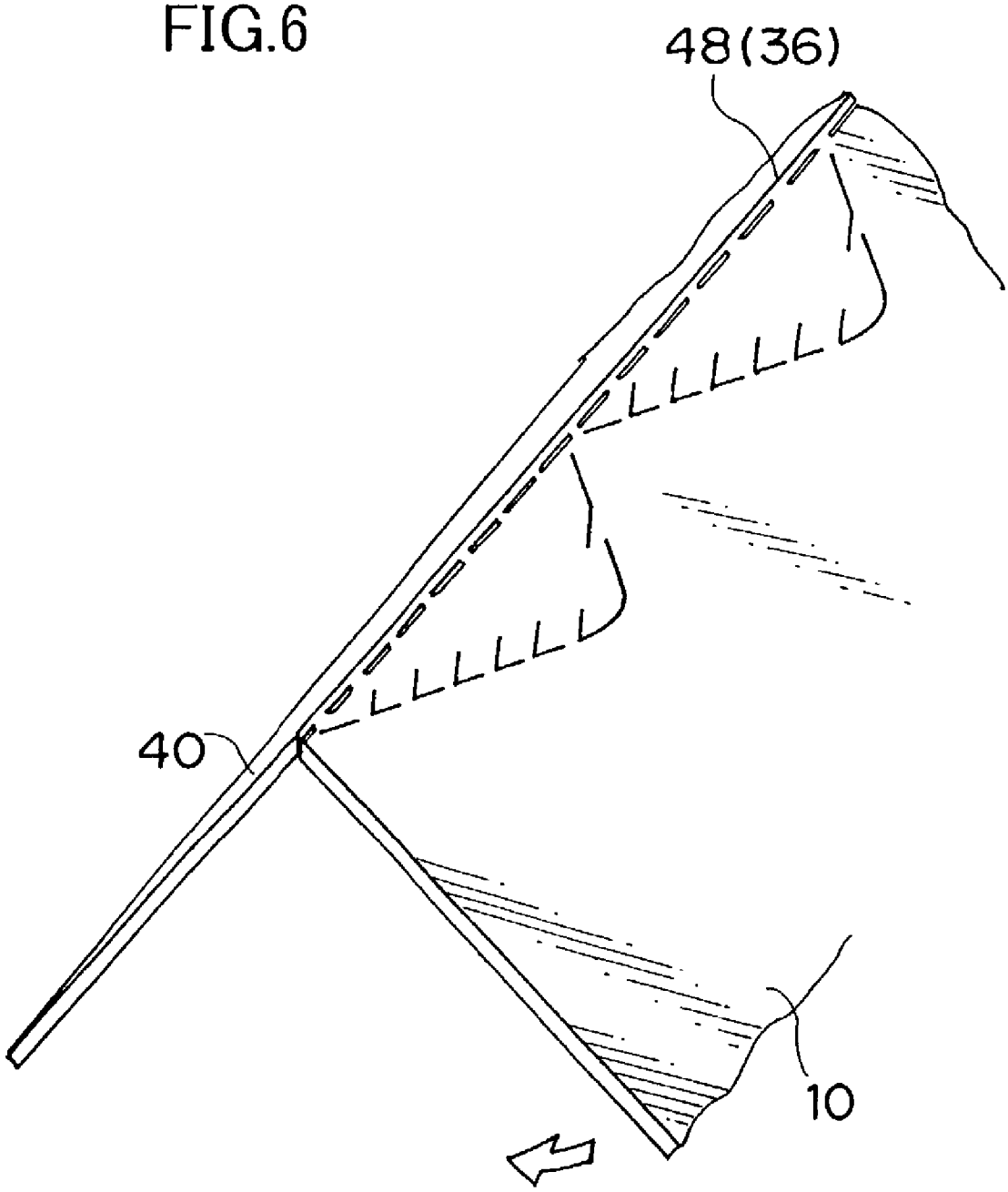
FIG. 6 is a schematic view explaining a state in which a quadrilateral tube, which is formed by four side plates, is formed from the unfolded state of the packaging case relating to the first embodiment of the present invention.
Figure 7:
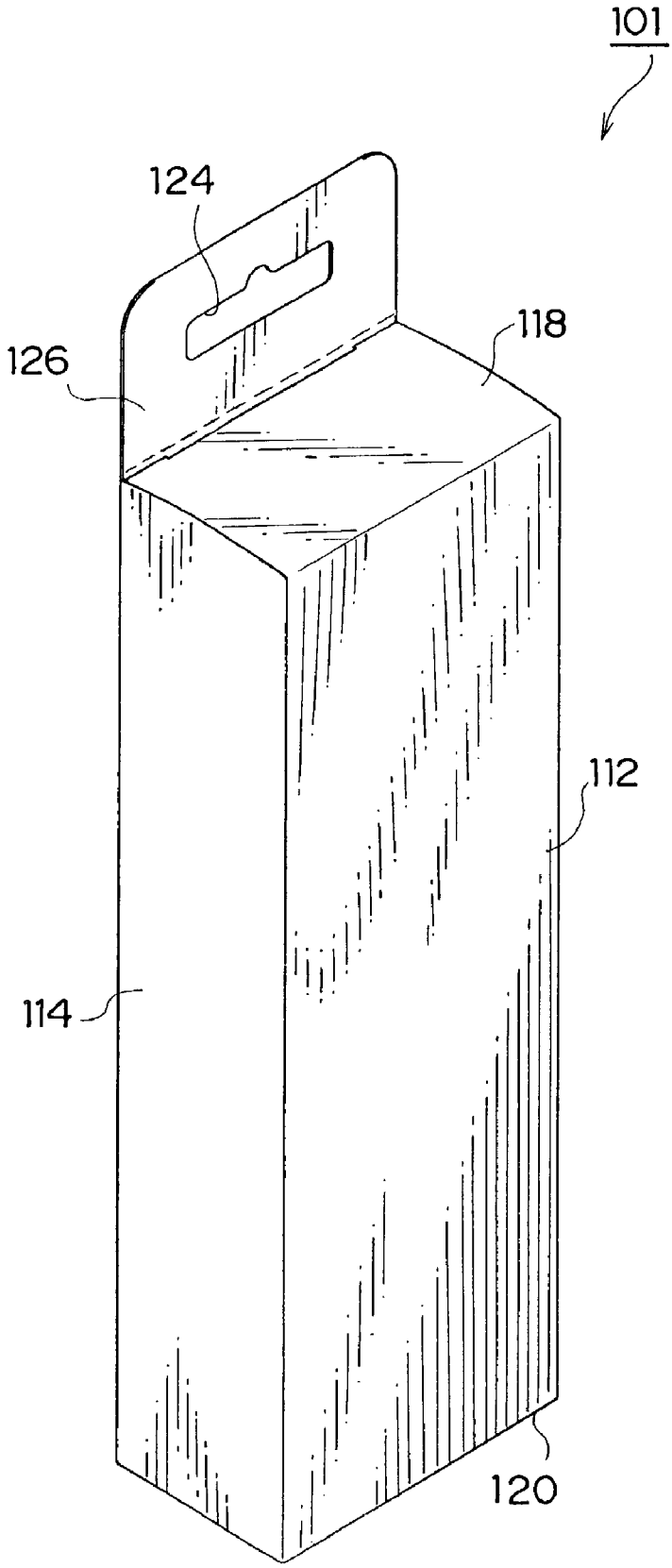
FIG. 7 is a perspective view showing a packaging case relating to a second embodiment of the present invention.
Figure 8:
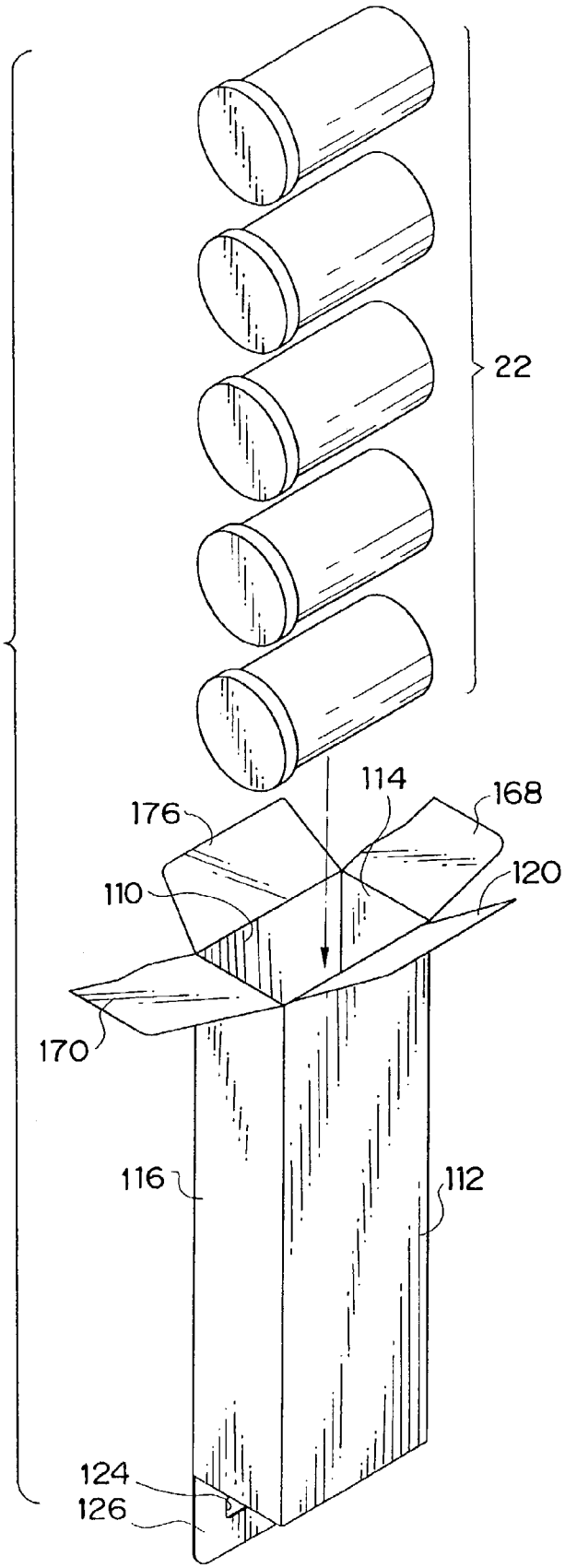
FIG. 8 is an exploded perspective view showing the packaging case relating to the second embodiment of the present invention.

Next, as shown in FIG. 5, the fold lines 42 and 46 are folded over and, of the joinedly connected side plates 10 to 16 and gluing overlap plate 40, the side plate 10 and the gluing overlap plate 40 are stuck together. Then this structure is opened up, and thus the quadrilateral tube formed of the side plates 10 to 16 is formed. At this time, because the perforation 36 is formed at the fold line 48 between the side plate 10 and the gluing overlap plate 40 of the packaging case 1, as shown in FIG. 6, reaction forces acting on the triangular waveform perforations 28 of the side plate 10 are small, and the side plate 10 and the gluing overlap plate 40 can be folded over without formation failures occurring, such as steps appearing at the triangular waveform perforations 28 and the triangular waveform perforations 28 getting broken. Particularly in cases in which paper grain substantially intersects the fold line 48, it is especially difficult to fold over the side plate 10 and the gluing overlap plate 40, and reaction forces on the triangular waveform perforations 28 of the side plate 10 that act at the time of folding tend to become large. However, the formation failures described above are avoided with the present embodiment.

Next, the inner flaps 58 and 60 of the side plates 14 and 16 are folded up along the fold lines 62 and 64, respectively, are each extended to central portion vicinities of the one end opening of the quadrilateral tube formed of the side plates 10 to 16, and cover the one end opening. The top plate 18 formed joined to the side plate 12 is folded along the fold line 66, is superposed with the inner flaps 58 and 60, and covers the one end opening of the quadrilateral tube formed by the side plates 10 to 16. At this time, the tongue piece 68 of the top plate 18 is folded along the fold line 70 and abutted against the side plate 10. Ordinarily, the cartridge containers 22 (storage items) will be stored in the packaging case 1 in this state (see FIG. 2).

The inner flaps 72 and 74 of the side plates 14 and 16 are folded up along the fold lines 76 and 78, respectively, are each extended to central portion vicinities of the other end opening of the quadrilateral tube formed by the side plates 10 to 16, and cover the other end opening. The outer flap 80 of the side plate 10 is folded along the fold line 82, is superposed with the inner flaps 72 and 74, and covers the other end opening of the quadrilateral tube formed by the side plates 10 to 16. The bottom plate 20 formed joined to the side plate 12 is folded along the fold line 84, is affixed to the outer flap 80, and covers the other end opening of the quadrilateral tube formed by the side plates 10 to 16. Thus, the packaging case 1 is formed.

This embodiment has been described for a mode in which perforations are formed to serve as the first to third non-continuous incision lines. However, the embodiment is not limited thus. For example, non-continuous incision lines in which cuts are formed with uncut portions remaining at certain points are also possible.

This embodiment has been described for a mode in which the triangular waveform perforations 28 and perforations 30 (the first non-continuous incision lines) are formed from the side plate 10 (the first flat plate) across the side plate 14 affixed to the gluing overlap plate 40, which serves as a flat plate adjacent to the side plate 10, and the perforation 36 (the second non-continuous incision line) is formed at the fold line 48 between the side plate 10 and the gluing overlap plate 40, which fold line 48 serves as a joining portion between the side plate 10 (the first flat plate) and the side plate 14. However, the embodiment is not limited thus. For example, the first non-continuous incision lines may be formed across any two flat plates which are formed to be joined via a fold line, and the second non-continuous incision line may be formed at a fold line that serves as a joining portion between these two flat plates.

This embodiment has been described for a mode in which the triangular waveform perforations 28 are formed at the side plate 10. However, there is no particular reason that the shape in which the triangular waveform perforations 28 are formed should be limited thus. For example, the triangular waveform perforations 28 may be formed in a rounded shape or a quadrilateral shape.

A mode in which the packaging case 1 is for photographic films and stores the cartridge containers 22 which accommodate photographic films has been illustrated for this embodiment. However, there is no particular reason to limit the embodiment thus, and any desired stored items can be stored.

Hereabove, in accordance with the present invention, a packaging case which can store a plurality of stored items, enables individual removal of the stored items, and avoids the occurrence of formation failures can be provided.

<<Second Embodiment>>

Hereafter, a second embodiment of the present invention will be described with reference to FIGS. 7 to 14.

A packaging case 101 shown in FIGS. 7 to 14 is structured in a cuboid shape which includes side plates 110, 112, 114 and 116, a top plate 118, a bottom plate 120 and a header 126. The side plates 110 to 116 (the first flat plate to the fourth flat plate) form a quadrilateral tube. The top plate 118 (the fifth flat plate) covers an opening at one end of the quadrilateral tube (the first opening). The bottom plate 120 (the sixth flat plate) covers an opening at the other end of the quadrilateral tube (the second opening). The header 126 is provided with a hanging opening 124. The packaging case 101 has a form which stores five of the horizontally oriented cylinder-like cartridge containers 22 (stored items) arrayed in the quadrilateral tube structured by the side plates 110 to 116. The cartridge containers 22 accommodate the cartridges (not shown) in which the photographic films (not shown) are stored in roll form. Note that the number of stored items is not limited to five, and can be appropriately selected from any desired number.

Figure 9A:
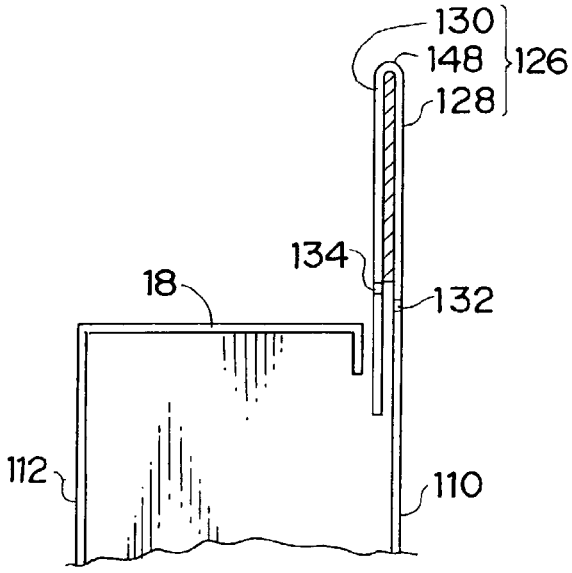
FIG. 9A is a side sectional view showing a header of the packaging case relating to the second embodiment of the present invention.

The header 126 is formed by a first protruding piece 128 and a second protruding piece 130, as shown in FIG. 9A. The header 126 is formed such that the second protruding piece 130 is affixed to the first protruding piece 128 and a distal end of the second protruding piece 130 is abutted against an inner wall of the side plate 110. Perforations 132 and 134 (non-continuous incision lines) are formed at peripheral edges of side plate 110 side end portions of the first protruding piece 128 and second protruding piece 130, respectively, together with fold lines (not shown) which are folded parallel with a face of the top plate 118. The perforations 132 and 134 are positioned slightly higher in a substantially vertical direction than the face of the top plate 118. The perforations 132 and 134 of the first protruding piece 128 and second protruding piece 130 are formed along the whole width of the first protruding piece 128 and second protruding piece 130 in a direction parallel to the top plate 118. The perforation 134 and fold line of the second protruding piece 130 are formed at a position higher in the substantially vertical direction with respect to the top plate 118 than a position of the perforation 132 and fold line of the first protruding piece 128. The first protruding piece 128 and an adhesion region are affixed at a hanging opening 124 side relative to the perforation 134 and fold line of the second protruding piece 130. Non-continuous incision lines formed at the first protruding piece 128 and second protruding piece 130 are not limited to the perforations 132 and 134. For example, non-continuous incision lines in which cuts are formed with uncut portions remaining at certain points are also possible. Note that oblique lines in the drawings represent an adhesion portion between the first protruding piece 128 and the second protruding piece 130.

Figure 9B:
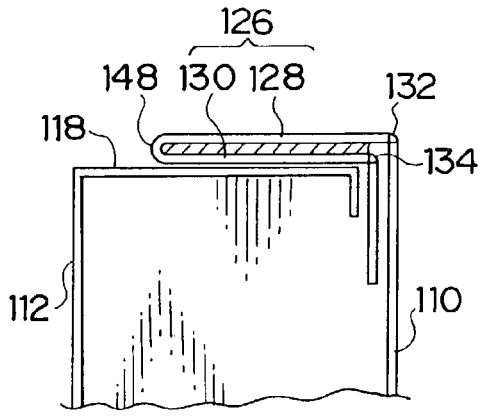
FIG. 9B is a side sectional view showing a state in which the header of the packaging case relating to the second embodiment of the present invention is folded down.
Figure 10:
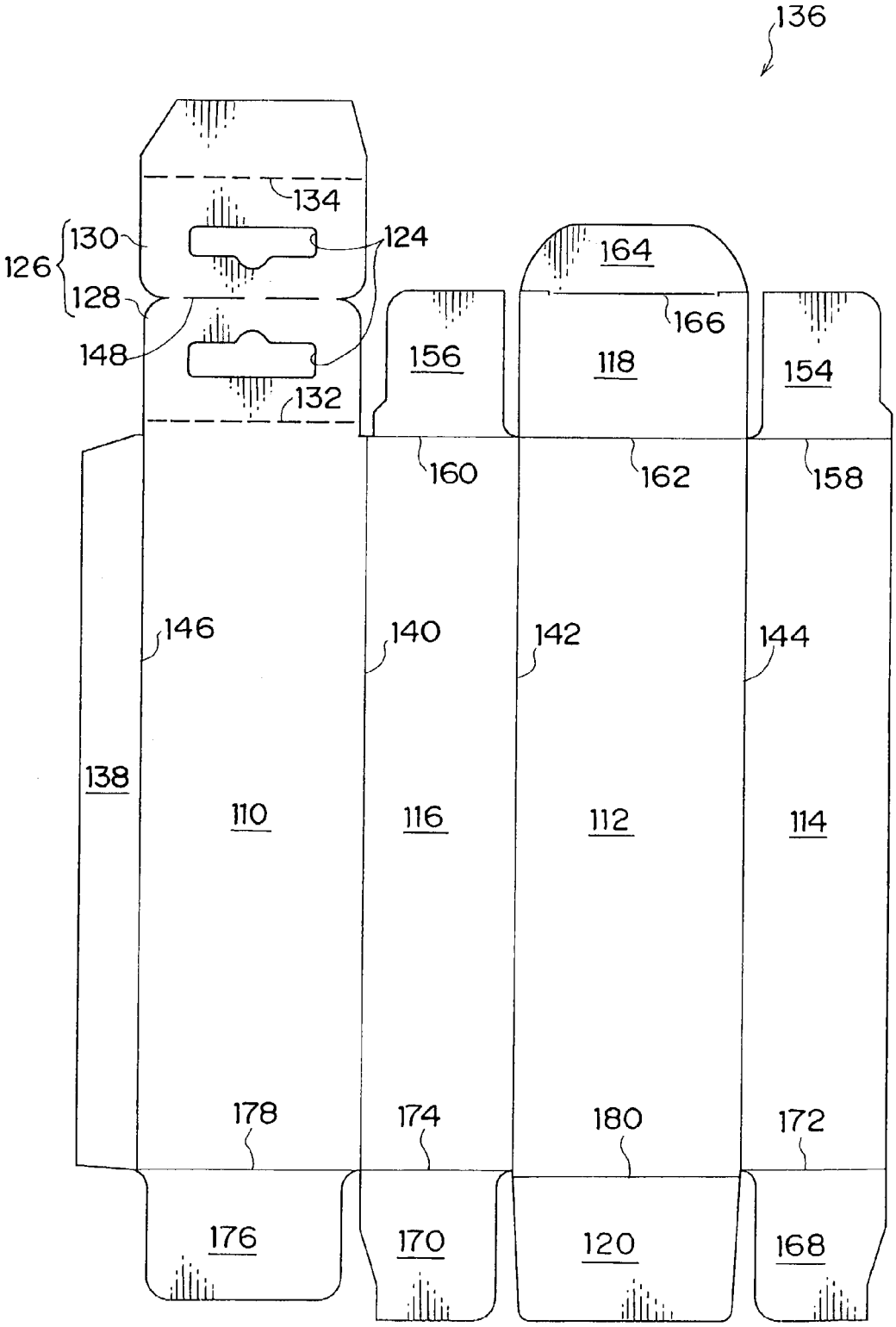
FIG. 10 is a development view, seen from an inner side, showing an unfolded state of the packaging case relating to the second embodiment of the present invention.

Accordingly, when the header 126 is folded so as to abut against the face of the top plate 118, the perforation 132 of the first protruding piece 128 and the perforation 134 of the second protruding piece 130 at the header 126 become folding portions, as shown in FIG. 9B. Because these folding portions are at positions higher in the substantially vertical direction than the face of the top plate 118, a state in which a gap is formed between the header 126 and the face of the top plate 118 is attained, and the header 126 does not interfere with the top plate 118. Thus, the header 126 can easily be folded to abut against the face of the top plate 118.

Further, when the header 126 is folded so as to abut against the face of the top plate 118, because the perforation 134 of the second protruding piece 130 at the header 126 is formed at a position higher from the face of the top plate 118 in the substantially vertical direction than the position of the perforation 132 of the first protruding piece 128, reaction forces due to tension of the folded portion at the perforation 132 of the first protruding piece 128 and the folded portion at the perforation 134 of the second protruding piece 130 are reduced. Thus, the header 126 can be easily folded to abut against the top plate 118.

A paper product sheet (a blank) 136 of the packaging case 101 in an unfolded state is formed with the side plates 110 to 116 and a gluing overlap plate 138 being joined via respective fold lines 140, 142, 144 and 146. A paper grain of the paper product sheet 136 runs in a direction substantially intersecting the fold lines 140 to 146.

Figure 11:
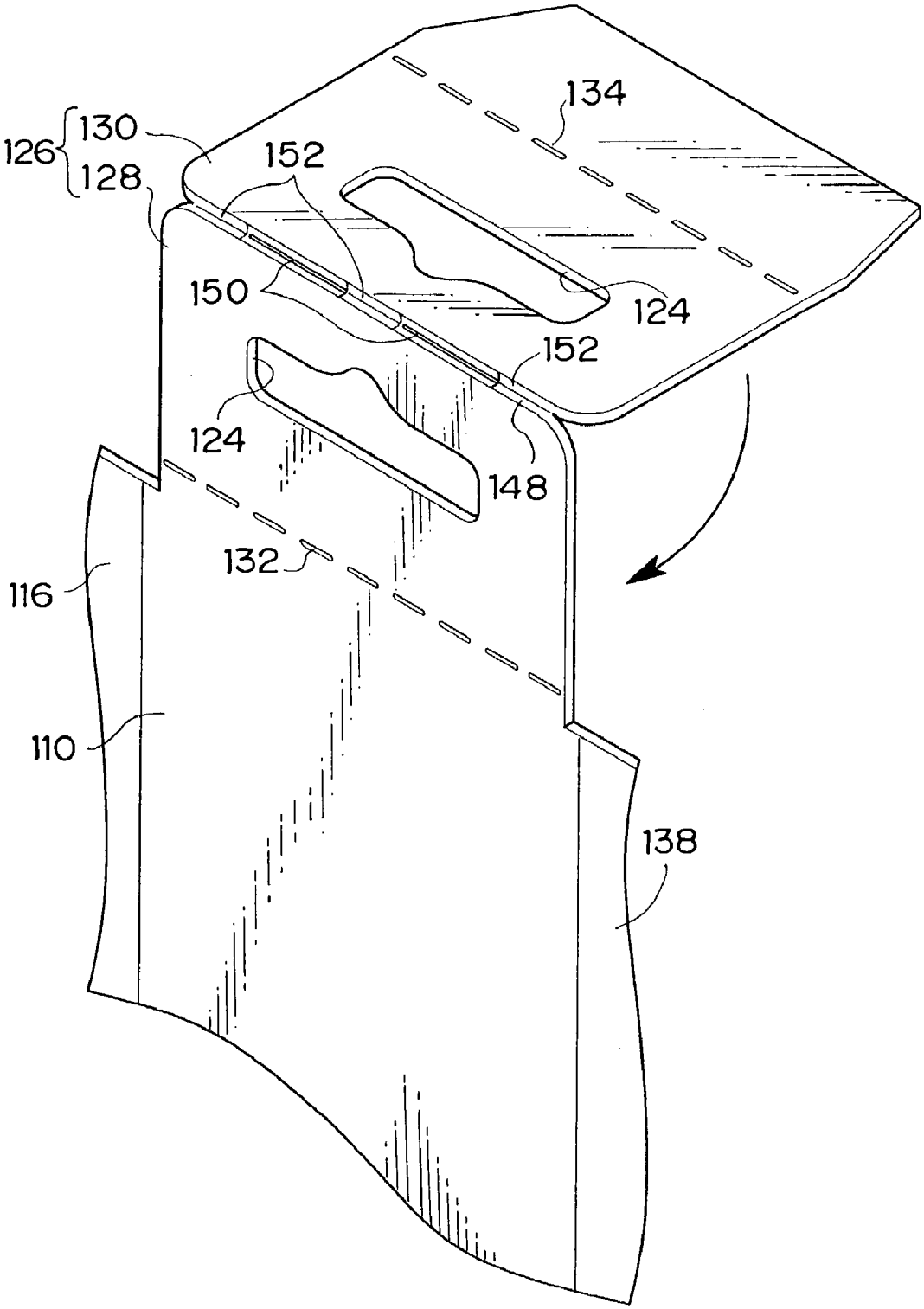
FIG. 11 is an enlarged view showing the header of the packaging case relating to the second embodiment of the present invention.

The first protruding piece 128 and the second protruding piece 130, which structure the header 126, are formed to be connected in series at the side plate 110. The first protruding piece 128 and second protruding piece 130 are formed to be joined via a fold line 148. As shown in FIG. 11, a non-continuous incision line, which is formed by cuts 150 and uncut portions 152, is formed at this fold line 148, and a half-cut portion is implemented at a side of a face of the fold line 148 that is opposite, in a thickness direction of the first protruding piece 128 and second protruding piece 130, to the affixed face. This half-cut portion is scored to a depth of approximately half a thickness dimension of the first protruding piece 128 and second protruding piece 130. Because of this structure, the second protruding piece 130 folds along the fold line 148 easily, and formation failures are unlikely to occur. A mode in which a perforation is formed to serve as the non-continuous incision line formed at the fold line 148 is also possible.

Inner flaps 154 and 156 are formed at the side plates 114 and 116 and joined therewith via fold lines 158 and 160, respectively. The inner flaps 154 and 156 each extend as far as a central vicinity of the one end opening of the quadrilateral tube formed by the side plates 110 to 116 and cover the one end opening (the first opening). The top plate 118, which covers the one end opening of the quadrilateral tube formed by the side plates 110 to 116, is formed at the side plate 112 via a fold line 162. A tongue piece 164 is formed at the top plate 118, via a fold line 166. The tongue piece 164 is abutted against the side plate 110 when the top plate 118 covers the one end opening of the quadrilateral tube formed by the side plates 110 to 116.

Inner flaps 168 and 170 are formed at the side plates 114 and 116 and joined therewith via fold lines 172 and 174, respectively. The inner flaps 168 and 170 each extend as far as a central vicinity of the other end opening of the quadrilateral tube formed by the side plates 110 to 116 and cover the other end opening (the second opening). An outer flap 176 is formed at the side plate 110 via a fold line 178. The outer flap 176 covers the other end opening of the quadrilateral tube formed by the side plates 110 to 116. The bottom plate 120, which covers the other end opening of the quadrilateral tube formed by the side plates 110 to 116, is formed at the side plate 112 via a fold line 180.

The packaging case 101 is formed by folding the paper product sheet 136 in the unfolded state up, with valley folds along the respective fold lines, and affixing predetermined portions. Herein, folding of the fold lines is not particularly limited. As well as valley folds and mountain folds, folding portions include folding lines and the like that are represented by perforations, scoring and folding portions, which are specified at a printing line, an automatic box-making machine or the like.

First, the second protruding piece 130 is folded up along the fold line 148, the second protruding piece 130 is affixed to the first protruding piece 128, and a distal end of the second protruding piece 130 is affixed to an inner wall of the side plate 110. Thus, the header 126 is formed.

Figure 12:
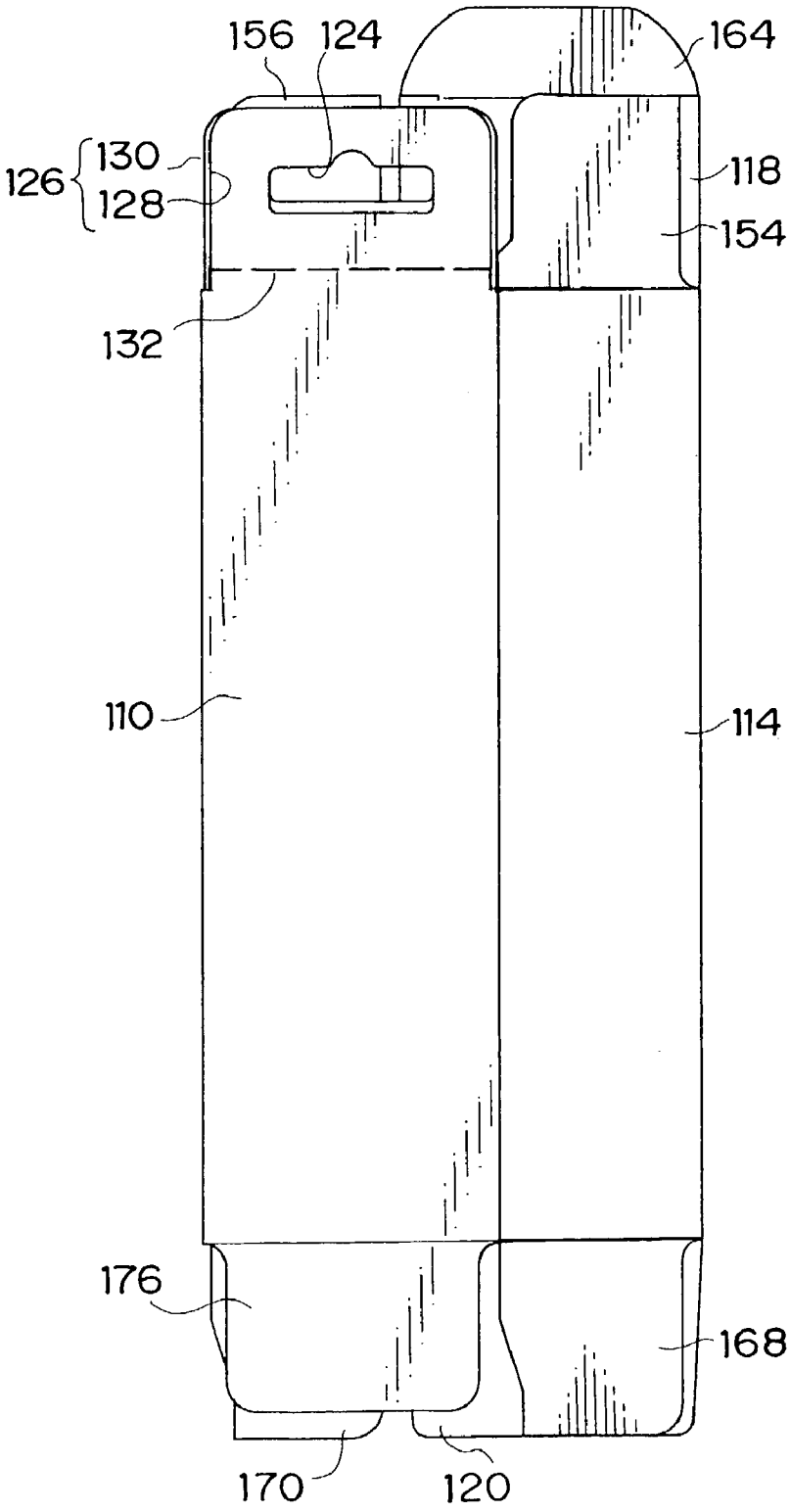
FIG. 12 is a schematic view explaining a process for assembling the packaging case relating to the second embodiment of the present invention from the unfolded state.

Next, as shown in FIG. 12, the fold lines 140 and 144 are folded over and, of the joinedly connected side plates 110 to 116 and gluing overlap plate 138, the side plate 110 and the gluing overlap plate 138 are folded so as to be stuck together. Then this structure is opened up, and thus the quadrilateral tube formed of the side plates 110 to 116 is formed.

Next, the inner flaps 154 and 156 of the side plates 114 and 116 are folded up along the fold lines 158 and 160, respectively, are each extended to central portion vicinities of the one end opening of the quadrilateral tube formed of the side plates 110 to 116, and cover the one end opening. The top plate 118 formed joined to the side plate 112 is folded along the fold line 162, is superposed with the inner flaps 154 and 156, and covers the one end opening of the quadrilateral tube formed by the side plates 110 to 116. At this time, the tongue piece 164 of the top plate 118 is folded along the fold line 166, and abutted against the side plate 110. Ordinarily, the cartridge containers 22 (storage items) will be stored in the packaging case 101 in this state (see FIG. 8).

The inner flaps 168 and 170 of the side plates 114 and 116 are folded up along the fold lines 172 and 174, respectively, are each extended to central portion vicinities of the other end opening of the quadrilateral tube formed by the side plates 110 to 116, and cover the other end opening. The outer flap 176 of the side plate 110 is folded along the fold line 178, is superposed with the inner flaps 168 and 170, and covers the other end opening of the quadrilateral tube formed by the side plates 110 to 116. The bottom plate 120 formed joined to the side plate 112 is folded along the fold line 180, is affixed to the outer flap 176, and covers the other end opening of the quadrilateral tube formed by the side plates 110 to 116. Thus, the packaging case 101 is formed.

Figure 13:
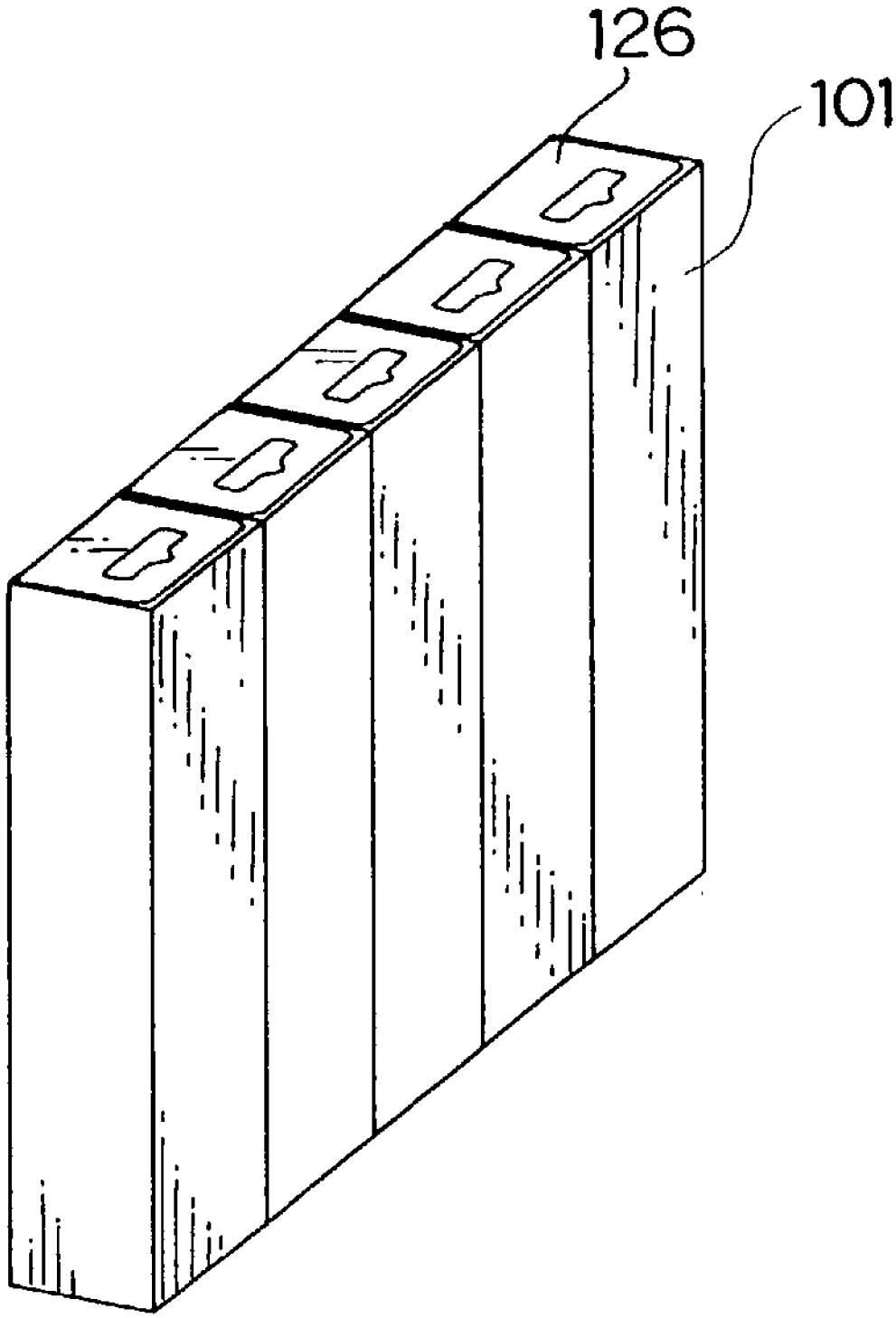
FIG. 13 is a schematic view showing a description of aggregation and wrapping of the packaging case relating to the second embodiment of the present invention.

When the packaging case 101 storing the cartridge containers 22 is shipped to intermediaries such as retailers, distributors and the like, the packaging case 101 is, for example, aggregated in a form in which five of the packaging case 101 are arranged in a line, with the headers 126 facing upward, and closely contacted and wrapped by thermo-shrinking shrink film, as shown in FIG. 13. In such a case, the headers 126 are folded so as to abut against faces of the top plates 118 of the packaging cases 101 for wrapping. As described above, the headers 126 do not lift up from the top plate 118 faces of the packaging cases 101, and the packaging cases 101 are wrapped with an attractive appearance.

Figure 14:
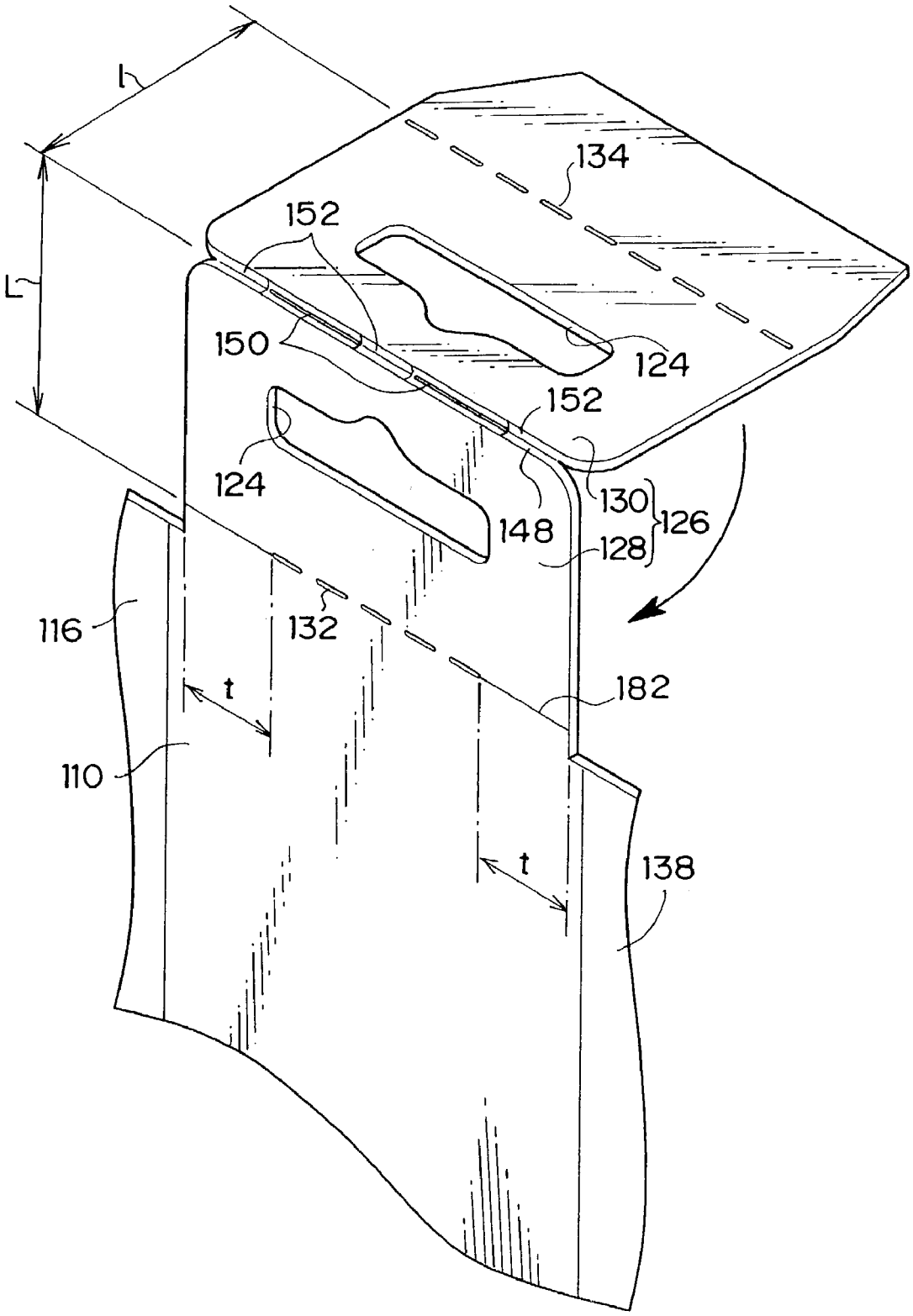
FIG. 14 is an enlarged view of a header of a packaging case relating to a variant example of the second embodiment.
Figure 15:
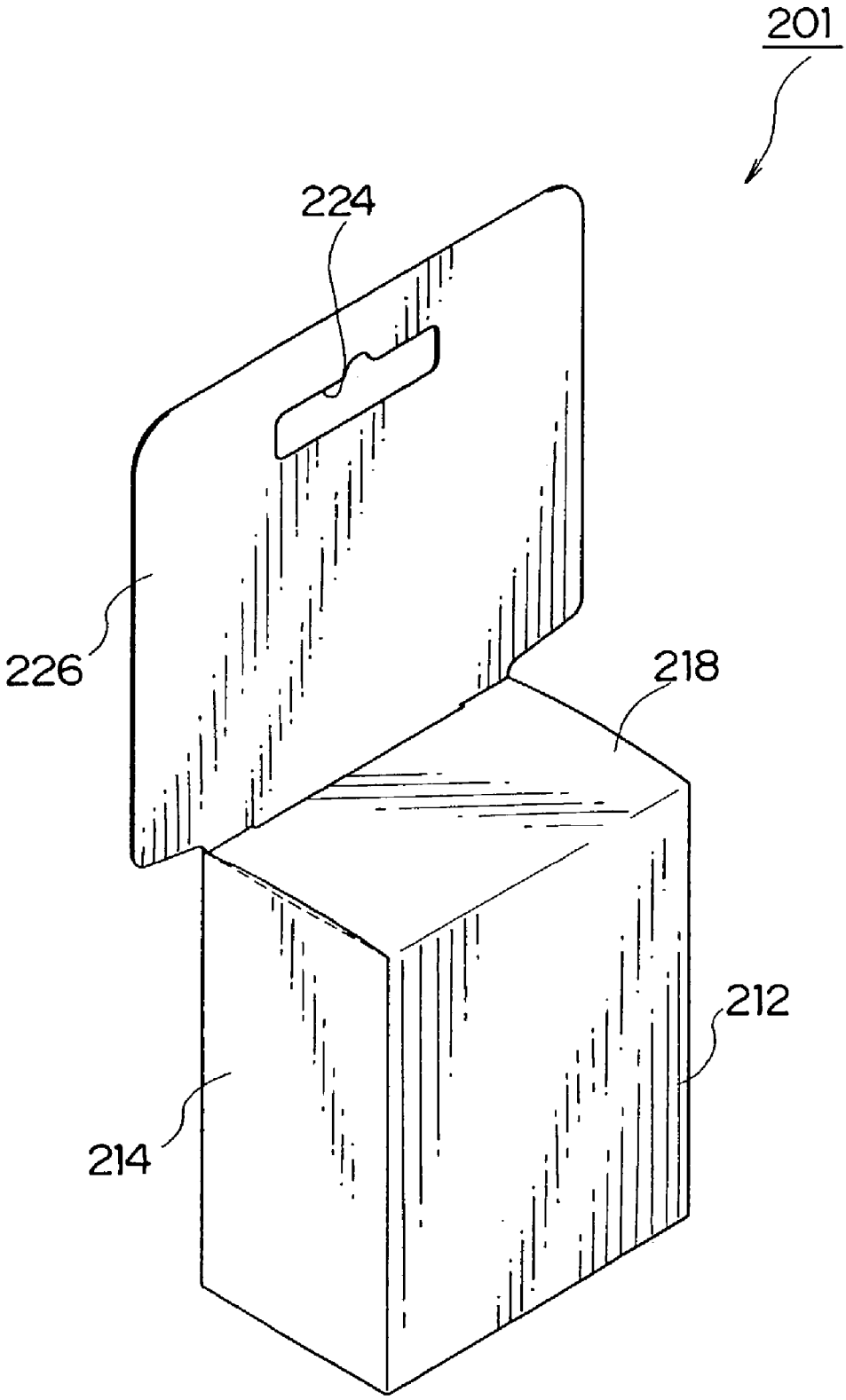
FIG. 15 is a perspective view showing a packaging case relating to a third embodiment of the present invention.
Figure 16:
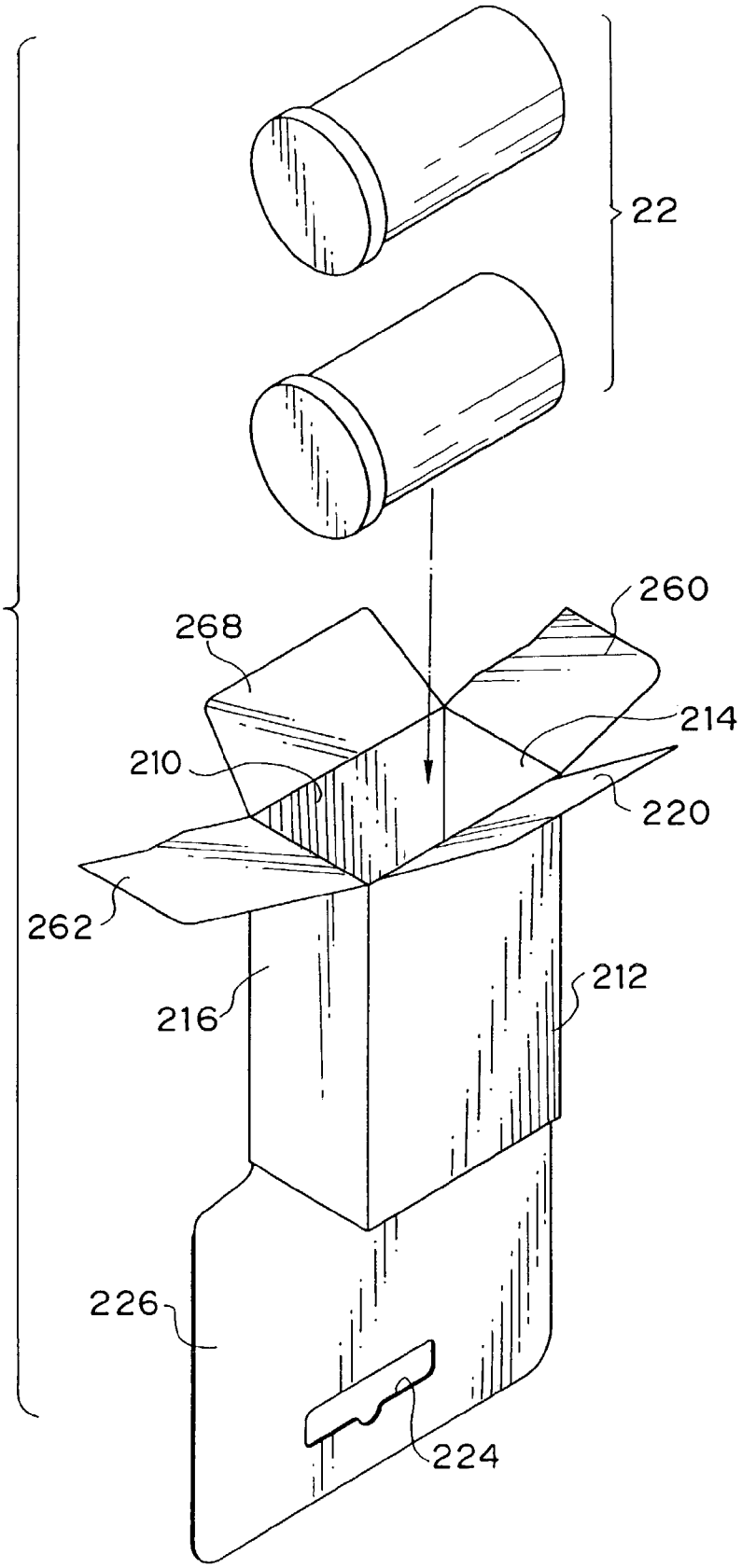
FIG. 16 is an exploded perspective view showing the packaging case relating to the third embodiment of the present invention.

This embodiment has been described for a mode in which the perforation 132 and fold line of the first protruding piece 128 are formed at the whole width of the first protruding piece 128 in a direction parallel to the top plate 118 face. However, the embodiment is not limited thus. As shown in FIG. 14, the perforation 132 of the first protruding piece 128 may be formed at a central region, in the width direction parallel to the top plate 118 face, of the first protruding piece 128. In FIG. 14, the reference numeral 182 indicates a fold line formed at the whole width of the header 126, and the perforation 132 is formed on this fold line 182. Respective lengths along the fold line 182 from each end of the perforation 132 to side edges of the first protruding piece 128 (indicated by "t" in the drawing) are around 3 to 10 mm, and are preferably specified to be approximately 5 mm. The header 126 may be broken away, from the side edges, when a force is applied to the header 126 at an angle with respect to a substantially vertical direction from the top plate 118 face. In particular, if both ends of the perforation 132 reach the side edges of the first protruding piece 128 (the header 126), the header 126 will be broken away from the side edges. Therefore, because the perforation 132 of the first protruding piece 128 is formed at the central width region of the first protruding piece 128 in the direction parallel to the top plate 118 face, that is, without both ends of the perforation 132 reaching the side edges of the first protruding piece 128, the strength of edge vicinities at the side edges of the header 126 is assured, and breakage from the side edges of the header 126 is prevented. Note that L>1 (see FIG. 14).

A mode in which the packaging case 101 is for photographic films and stores the cartridge containers 22 which accommodate photographic films has been illustrated for this embodiment. However, there is no particular reason to limit the embodiment thus, and any desired stored items can be stored.

Hereabove, in accordance with the present invention, a packaging case at which a header provided with a suspension opening can be easily folded to abut against a face of the packaging case can be provided.

<<Third Embodiment>>

Hereafter, a third embodiment of the present invention will be described with reference to FIGS. 15 to 20B.

A packaging case 201 shown in FIGS. 15 to 18 is structured in a cuboid shape which includes side plates 210, 212, 214 and 216, a top plate 218, a bottom plate 220 and a header 226. The side plates 210 to 216 (the first flat plate to the fourth flat plate) form a quadrilateral tube. The top plate 218 (the fifth flat plate) covers an opening at one end of the quadrilateral tube (the first opening). The bottom plate 220 (the sixth flat plate) covers an opening at the other end of the quadrilateral tube (the second opening). The header 226 is provided with a hanging opening 24. The packaging case 201 has a form which stores two of the horizontally oriented cylinder-like cartridge containers 22 (stored items) arrayed in the quadrilateral tube structured by the side plates 210 to 216. The cartridge containers 22 accommodate the cartridges (not shown) in which the photographic films (not shown) are stored in roll form. Note that the number of stored items is not limited to two, and can be appropriately selected from any desired number.

The header 226 has a maximum width in a direction parallel to a face of the top plate 218 which is greater than a width of the side plate 210 in the direction parallel to the top plate 218 face.

Figure 17:
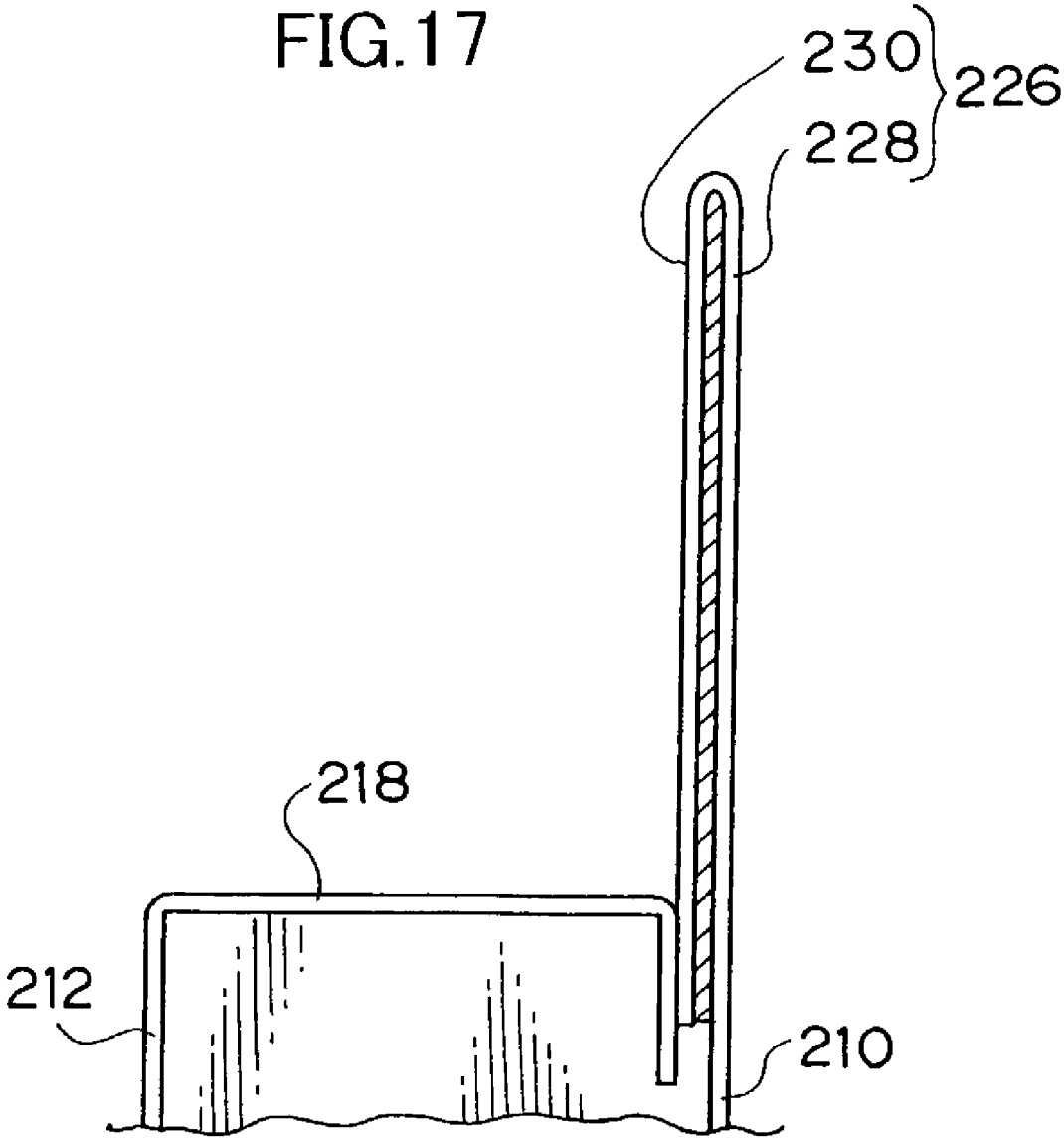
FIG. 17 is a side sectional view showing a header of the packaging case relating to the third embodiment of the present invention.
Figure 18:
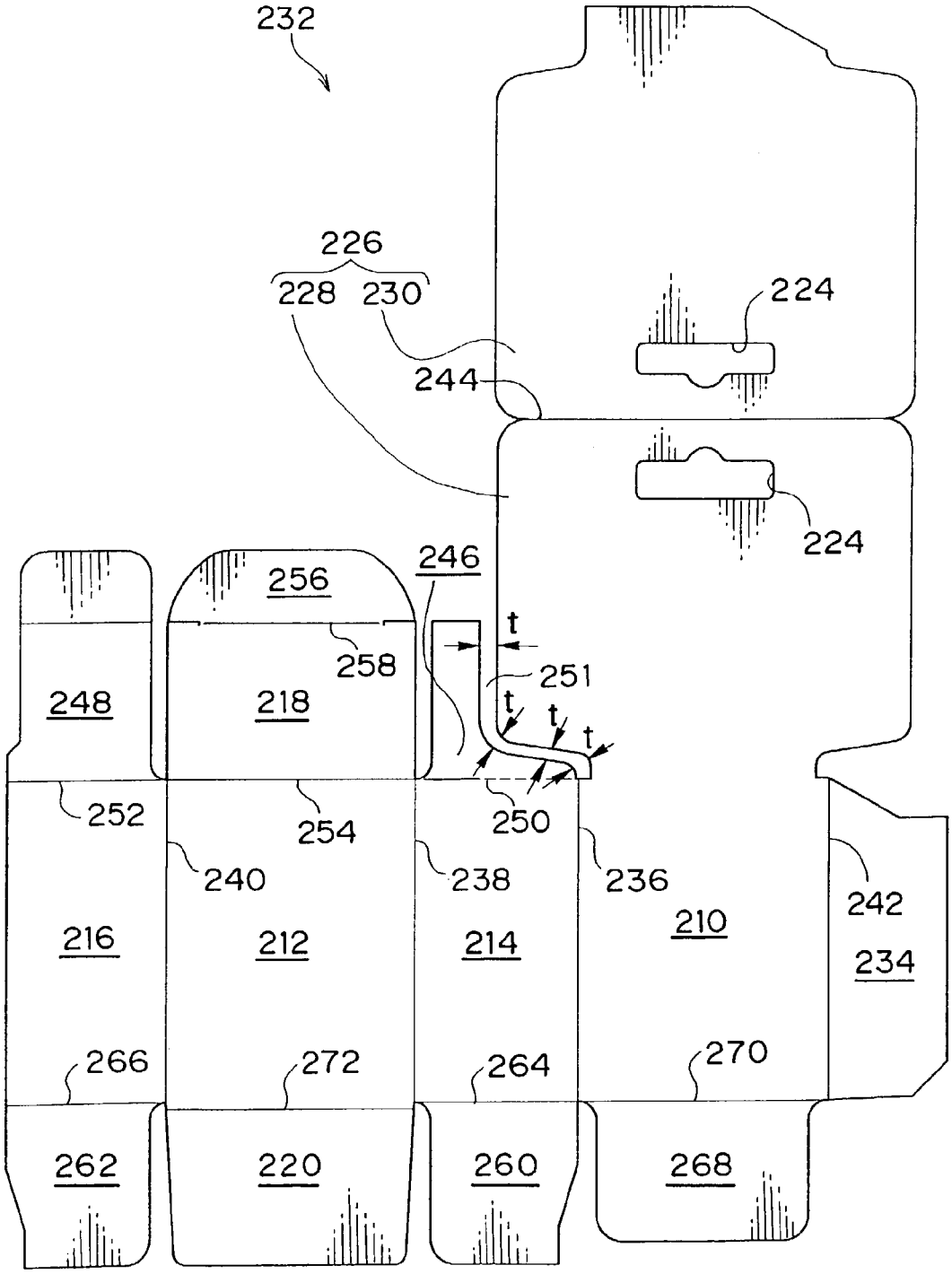
FIG. 18 is a development view, seen from an inner side, showing an unfolded state of the packaging case relating to the third embodiment of the present invention.

The header 226 is formed by a first protruding piece 228 and a second protruding piece 230, as shown in FIG. 17. The header 226 is formed such that the second protruding piece 230 is affixed to the first protruding piece 228 and a distal end of the second protruding piece 230 is abutted against an inner wall of the side plate 210. Consequently, a joining portion between the header 226 and the side plate 210 is reinforced by the distal end of the second protruding piece 230, and therefore the header 226 is resistant to folding. Note that the oblique lines in the drawing indicate an adhesion portion between the first protruding piece 228 and the second protruding piece 230.

A paper product sheet (a blank) 232 of the packaging case 201 in an unfolded state is formed with the side plates 210 to 216 and a gluing overlap plate 234 being joined via respective fold lines 236, 238, 240 and 242. A paper grain of the paper product sheet 232 runs in a direction substantially intersecting the fold lines 236 to 242.

The first protruding piece 228 and the second protruding piece 230, which structure the header 226, are formed to be connected in series at the side plate 210. The first protruding piece 228 and second protruding piece 230 are formed to be joined via a fold line 244.

Inner flaps 246 and 248 (first flaps) are formed at the side plates 214 and 216 and joined therewith via fold lines 250 and 252, respectively. The inner flaps 246 and 248 each extend as far as a central vicinity of the one end opening of the quadrilateral tube formed by the side plates 210 to 216 and cover the one end opening (the first opening). Of the inner flap 246 and the inner flap 248, the inner flap 246, which is adjacent to the header 226 structured by the first protruding piece 228 and second protruding piece 230, is formed to be cut away so as to be provided with a continuous gap 251 with a predetermined width (indicated by t in the drawing) from a side edge of the header 226 (a side edge of the first protruding piece 228 In the unfolded state). Consequently, when the quadrilateral tube formed by the side plates 210 to 216 is being formed or when the inner flap 246 is being folded to be perpendicular to the side plate 214, or the like, the header 226 and the inner flap 246 do not impede or get caught on one another, assembly accuracy is improved, and occurrences of formation failures are prevented.

At the fold line 250, which is a joining portion between the side plate 214 and the inner flap 246, a perforation is formed at a portion that is formed joining and interposed between a portion of the inner flap 246 that is formed to be cut away and the side plate 214. At the inner flap 246, which includes the portion of the inner flap 246 that is formed to be cut away in line with the side edge of the header 226, the portion of the inner flap 246 that is formed to be cut away is hard to fold, even when a distal end of the inner flap 246 is pinched or pushed for folding. Thus, the inner flap 246 can be folded more easily when the perforation has been formed. The perforation formed at the fold line 250 is not limited thus. For example, a non-continuous incision line in which cuts are formed with uncut portions remaining at certain points is also possible. Further, perforations may be formed at the whole of the fold line 250.

The top plate 218, which covers the one end opening of the quadrilateral tube formed by the side plates 210 to 216, is formed at the side plate 212 via a fold line 254. A tongue piece 256 is formed at the top plate 218, via a fold line 258. The tongue piece 256 is abutted against the side plate 210 when the top plate 218 covers the one end opening of the quadrilateral tube formed by the side plates 210 to 216.

Inner flaps 260 and 262 are formed at the side plates 214 and 216 and joined therewith via fold lines 264 and 266, respectively. The inner flaps 260 and 262 each extend as far as a central vicinity of the other end opening of the quadrilateral tube formed by the side plates 210 to 216 and cover the other end opening. An outer flap 268 is formed at the side plate 210 via a fold line 270. The outer flap 268 covers the other end opening of the quadrilateral tube formed by the side plates 210 to 216. The bottom plate 220, which covers the other end opening of the quadrilateral tube formed by the side plates 210 to 216, is formed at the side plate 212 via a fold line 272.

The packaging case 201 is formed by folding the paper product sheet 232 in the unfolded state up, with valley folds along the respective fold lines, and affixing predetermined portions. Herein, folding of the fold lines is not particularly limited. As well as valley folds and mountain folds, folding portions include folding lines and the like that are represented by perforations, scoring and folding portions, which are specified at a printing line, an automatic box-making machine or the like.

First, the second protruding piece 230 is folded up along the fold line 244, the second protruding piece 230 is affixed to the first protruding piece 228, and a distal end of the second protruding piece 230 is affixed to an inner wall of the side plate 210. Thus, the header 226 is formed.

Figure 19:
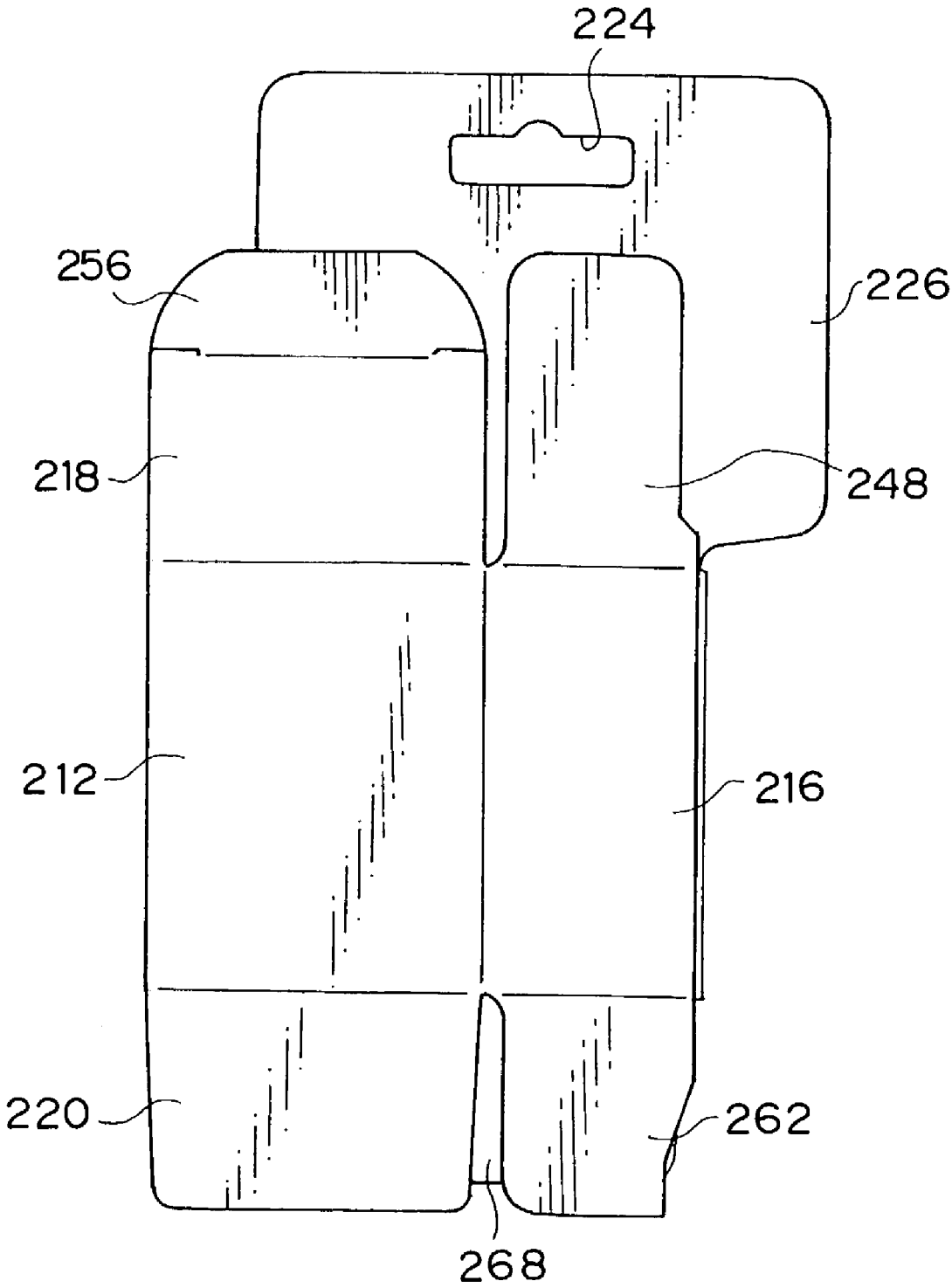
FIG. 19 is a schematic view explaining a process for assembling the packaging case relating to the third embodiment of the present invention from the unfolded state.
Figure 20A:
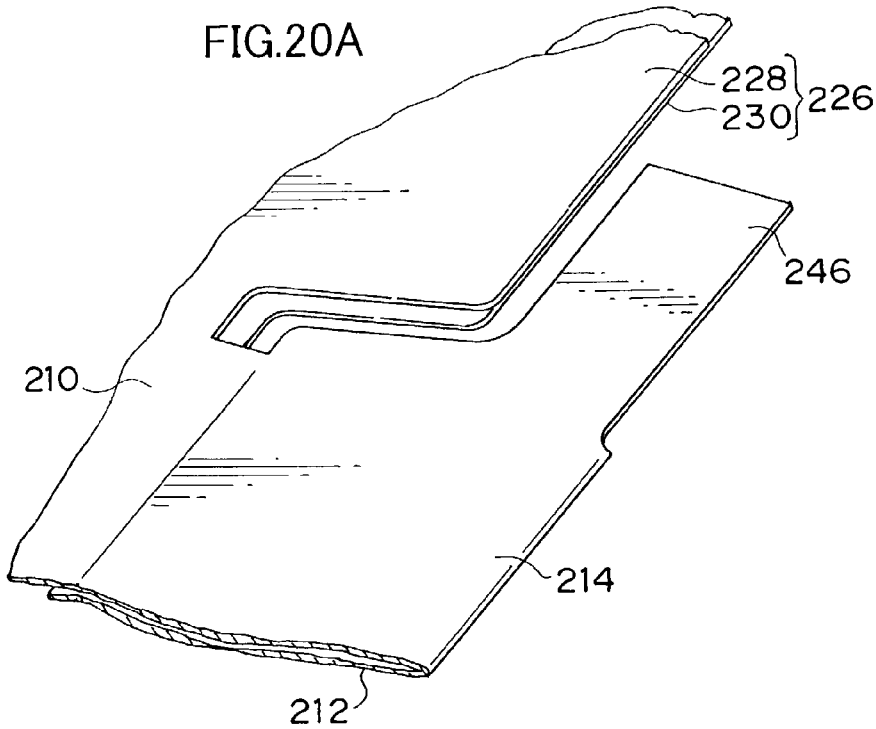
FIG. 20A is a view showing one step in forming a quadrilateral tube, which is formed by four side plates, from the unfolded state of the packaging case relating to the third embodiment of the present invention.
Figure 20B:
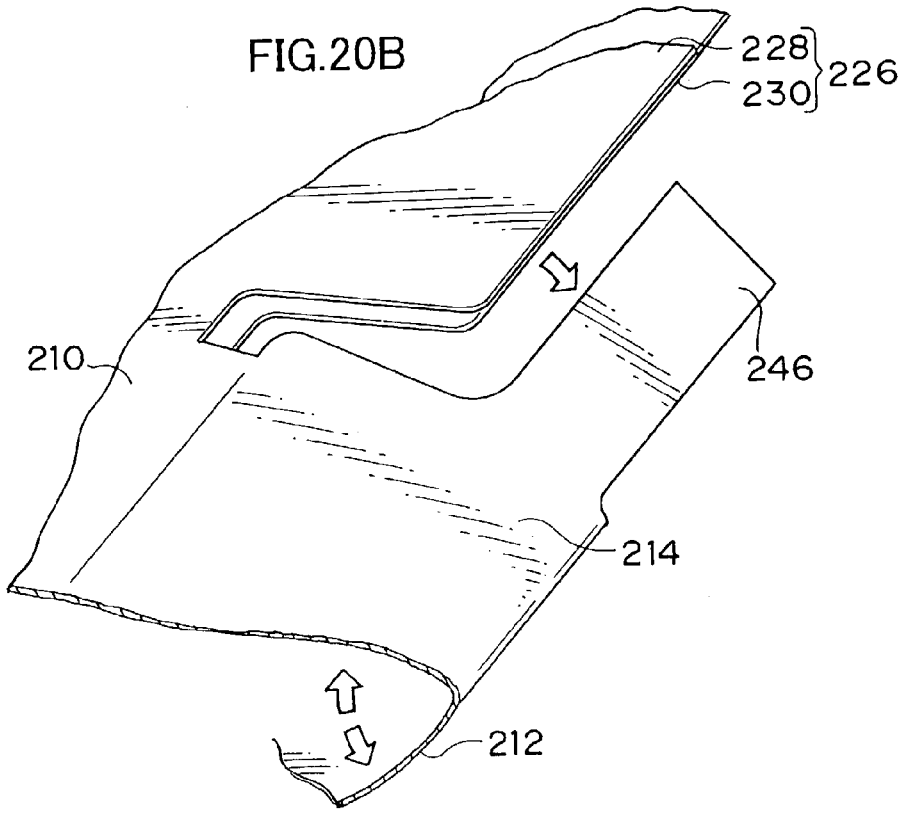
FIG. 20B is a view showing another step in forming the quadrilateral tube.

Next, as shown in FIG. 19, the fold lines 242 and 238 are folded over and, of the joinedly connected side plates 210 to 216 and gluing overlap plate 234, the side plate 216 and the gluing overlap plate 234 are stuck together. Then this structure is opened up, and thus the quadrilateral tube formed of the side plates 210 to 216 is formed. As shown in FIGS. 20A and 20B, from the state in which the fold lines 242 and 238 have been folded and the side plate 216 and gluing overlap plate 234 have been affixed (FIG. 20A), when the packaging case 201 is opened out to form the quadrilateral tube (FIG. 20B), the header 226 and the inner flap 246 do not impede each other and do not catch on one another, assembly accuracy for forming the quadrilateral tube is improved, and occurrences of formation failures can be prevented.

Next, the inner flaps 246 and 248 of the side plates 214 and 216 are folded up along the fold lines 250 and 252, respectively, are each extended to central portion vicinities of the one end opening of the quadrilateral tube formed by the side plates 210 to 216, and cover the one end opening. The top plate 218 formed joined to the side plate 212 is folded along the fold line 254, is superposed with the inner flaps 246 and 248, and covers the one end opening of the quadrilateral tube formed by the side plates 210 to 216. At this time, the tongue piece 256 of the top plate 218 is folded along the fold line 258, and abutted against the side plate 210. Ordinarily, the cartridge containers 22 (storage items) will be stored in the packaging case 201 in this state (see FIG. 16).

The inner flaps 260 and 262 of the side plates 214 and 216 are folded up along the fold lines 264 and 266, respectively, are each extended to central portion vicinities of the other end opening of the quadrilateral tube formed by the side plates 210 to 216, and cover the other end opening. The outer flap 268 of the side plate 210 is folded along the fold line 270, is superposed with the inner flaps 260 and 262, and covers the other end opening of the quadrilateral tube formed by the side plates 210 to 216. The bottom plate 220 formed joined to the side plate 212 is folded along the fold line 272, is affixed to the outer flap 268, and covers the other end opening of the quadrilateral tube formed by the side plates 210 to 216. Thus, the packaging case 201 is formed.

This embodiment has been described for a mode in which only the one inner flap 246 serves as the first flap, which is formed to be cut away so as to provide the continuous predetermined gap between the inner flap 246 and the header 226 in the unfolded state of the packaging case 201. However, the embodiment is not limited thus. There may be two of the first flap neighboring the header 226 in the unfolded state of the packaging case 201, with these two flaps being formed to be cut away so as to provide continuous predetermined gaps between the two flaps and the side edges of the header 226.

A mode in which the packaging case 201 is for photographic films and stores the cartridge containers 22 which accommodating photographic films has been illustrated for this embodiment. However, there is no particular reason to limit the embodiment thus, and any desired stored items can be stored.

Hereabove, in accordance with the present invention, a packaging case which has a broad header, and which is excellent in assembly accuracy and prevents occurrences of formation failures, can be provided.

What is claimed is:

1. A packaging case including a main body having the form of a substantially quadrilateral tube, the packaging case being capable of storing a plurality of items substantially in a row along a longitudinal direction of the main body, the packaging case comprising:

a first panel for structuring the main body;

a second panel for structuring the main body, which opposes the first panel;

a third panel for structuring the main body, which connects the first panel and the second panel;

a fourth panel for structuring the main body, which opposes the third panel and connects the first panel and the second panel;

a fifth panel for covering a first opening at one end of the main body in the longitudinal direction;

a sixth panel for covering a second opening at the other end of the main body in the longitudinal direction;

a first protruding piece connected with the first panel via a first non-continuous incision line; and a second protruding piece connected with the first protruding piece via a fold line and including a second non-continuous incision line at a position spaced a predetermined distance from a distal end thereof, the second protruding piece being folded in a direction of entering into the main body and superposed with the first protruding piece, and the second protruding piece, together with the first protruding piece, structuring a header, wherein positions of the first non-continuous incision line and the second non-continuous incision line are vertically higher than a position of the fifth panel when the fifth panel has closed off the first opening, and wherein a dimension (L) from the first non-continuous incision line to the fold line is greater than a dimension (l) from the fold line to the second non-continuous incision line.

2. The packaging case of claim 1, wherein the fold line comprises at least one incision.

3. The packaging case of claim 1, wherein the fold line is a half-cut line, which is scored to a depth of the approximately half a thickness dimension of the header.

4. The packaging case of claim 1, wherein the header comprises a suspension opening.

5. The packaging case of claim 1, wherein the main body is constructed from a paper-related material.

* * * * *